US011807969B2

(12) United States Patent
Shiratsuchi

(10) Patent No.: US 11,807,969 B2
(45) Date of Patent: Nov. 7, 2023

(54) BOBBIN WINDING DEVICE AND SEWING MACHINE

(71) Applicant: JANOME SEWING MACHINE CO., LTD., Tokyo (JP)

(72) Inventor: Hiroki Shiratsuchi, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 171 days.

(21) Appl. No.: 17/349,461

(22) Filed: Jun. 16, 2021

(65) Prior Publication Data

US 2021/0404102 A1 Dec. 30, 2021

(30) Foreign Application Priority Data

Jun. 29, 2020 (JP) ..... 2020-111120

(51) Int. Cl.
*D05B 59/00* (2006.01)

(52) U.S. Cl.
CPC ..... *D05B 59/00* (2013.01)

(58) Field of Classification Search
CPC ..... D05B 57/265; D05B 57/26; D05B 59/00; D05B 59/04; B65H 54/18
See application file for complete search history.

(56) References Cited

U.S. PATENT DOCUMENTS

2010/0147989 A1* 6/2010 Fukao ..... B65H 54/12 242/484.7
2020/0340159 A1 10/2020 Ueda et al.

FOREIGN PATENT DOCUMENTS

EP 0194967 A1 * 1/1986 ..... D05B 59/00
JP 2019-129881 A 8/2019

* cited by examiner

*Primary Examiner* — Patrick J. Lynch
(74) *Attorney, Agent, or Firm* — Nakanishi IP Associates, LLC

(57) ABSTRACT

A bobbin winding device has a switching motor and a switching lever connected to the switching motor. The switching motor is driven by the control unit, and the switching lever is rotated, so that the intermediate position of the detection lever is changed to one side in the rotation direction of the detection lever. This allows changing the winding diameter of the bobbin thread wound on different bobbin diameters. Here, the bobbin winding device has a color sensor which detects the outer diameter of the bobbin mounted on the spool shaft. The control unit drives the switching motor to rotate the switching lever based on the detected outer diameter of the bobbin. Therefore, the user can wind the bobbin thread around the bobbins having different outer diameters without rotating the switching lever from the initial position based on the outer diameter of the bobbins to be mounted.

7 Claims, 16 Drawing Sheets

BOBBIN WINDING DEVICE AND SEWING MACHINE

BACKGROUND OF THE INVENTION

1. Field of the Invention

The present invention relates to a bobbin winding device and a sewing machine comprising the bobbin winding device.

2. Description of the Related Art

The bobbin winding device described in Patent Document 1 below includes a detecting means for detecting the winding amount of the bobbin and a lever for switching the detection result of the detecting means. By rotating the lever to the first adjustment rotation position or the second adjustment rotation position, the detection result of the detection means is switched. Thereby, the winding amount (winding diameter) of the bobbin thread wound around the bobbin can be changed. That is, for example, the bobbin thread can be wound around bobbins having different outer diameters.

RELATED ART DOCUMENTS

Patent Documents

Patent Document 1

Japanese Patent Application Laid-Open No. 2019-129881

However, in the bobbin winding device above, for example, when the bobbin is wound around the small-diameter bobbin with the lever aligned with the adjustment position corresponding to the large-diameter bobbin, there is a problem that the bobbin is excessively wound around the small-diameter bobbin.

Further, in the bobbin winding device above, for example, the user needs to switch the position of the lever according to the type of bobbin. Therefore, there is room for improvement in the bobbin winding device in terms of improving convenience for the user.

SUMMARY OF THE INVENTION

One or more embodiments of the present invention provide a bobbin winding device capable of improving convenience for a user and a sewing machine equipped with the bobbin winding device.

At least one embodiment of the present invention is a bobbin winding device comprising: a spool shaft on which a bobbin is mounted; a switch that detects the completion of winding the bobbin thread around the bobbin; a rotating body that is configured to be rotatable around an axis parallel to the spool shaft and that presses the switch by rotating from a non-pressing position separated from the switch to a pressing position via an intermediate position on one side of the rotation direction; a contact portion that is provided on the rotating body, wherein it is configured so that it can come into contact with the bobbin thread, and is arranged radially outside the core portion of the bobbin at the non-pressing position and is pressed by a bobbin thread wound around the bobbin to rotate the rotating body to one side in the rotation direction; an urging member that urges the rotating body on the other side of the rotating direction at the non-pressing position and on one side of the rotating direction at the pressing position, and switches the urging direction with respect to the rotating body at the intermediate position; a switching member that is configured to be rotatable around an axis parallel to the spool shaft, is connected to the urging member, and changes the intermediate position one side in the rotation direction of the rotating body by rotating from the initial position to one side in the rotation direction; a motor that is connected to the switching member and rotates the switching member by driving; an outer diameter detector that detects the outer diameter of the bobbin; and a control unit (e.g., including one or more processors) that drives the motor based on the outer diameter of the bobbin detected by the outer diameter detector and rotates the switching member from the initial position.

At least one embodiment of the present invention is a bobbin winding device, wherein the outer diameter detector is a color sensor that detects a part of the color of the bobbin.

At least one embodiment of the present invention is a bobbin winding device comprising a position changing member configured to be movable in conjunction with the rotation of the switching member and to be in contact with the rotating body at the non-pressing position, wherein, the switching member rotates from the initial position to one side in the rotation direction, and the rotating body comes into contact with the position changing member, so that the non-pressing position is changed to one side in the rotation direction of the rotating body.

At least one embodiment of the present invention is a sewing machine comprising a bobbin winding device having the above configuration.

According to one or more embodiments of the present invention, convenience for the user can be improved.

DETAILED DESCRIPTION OF THE INVENTION

Figure 1:
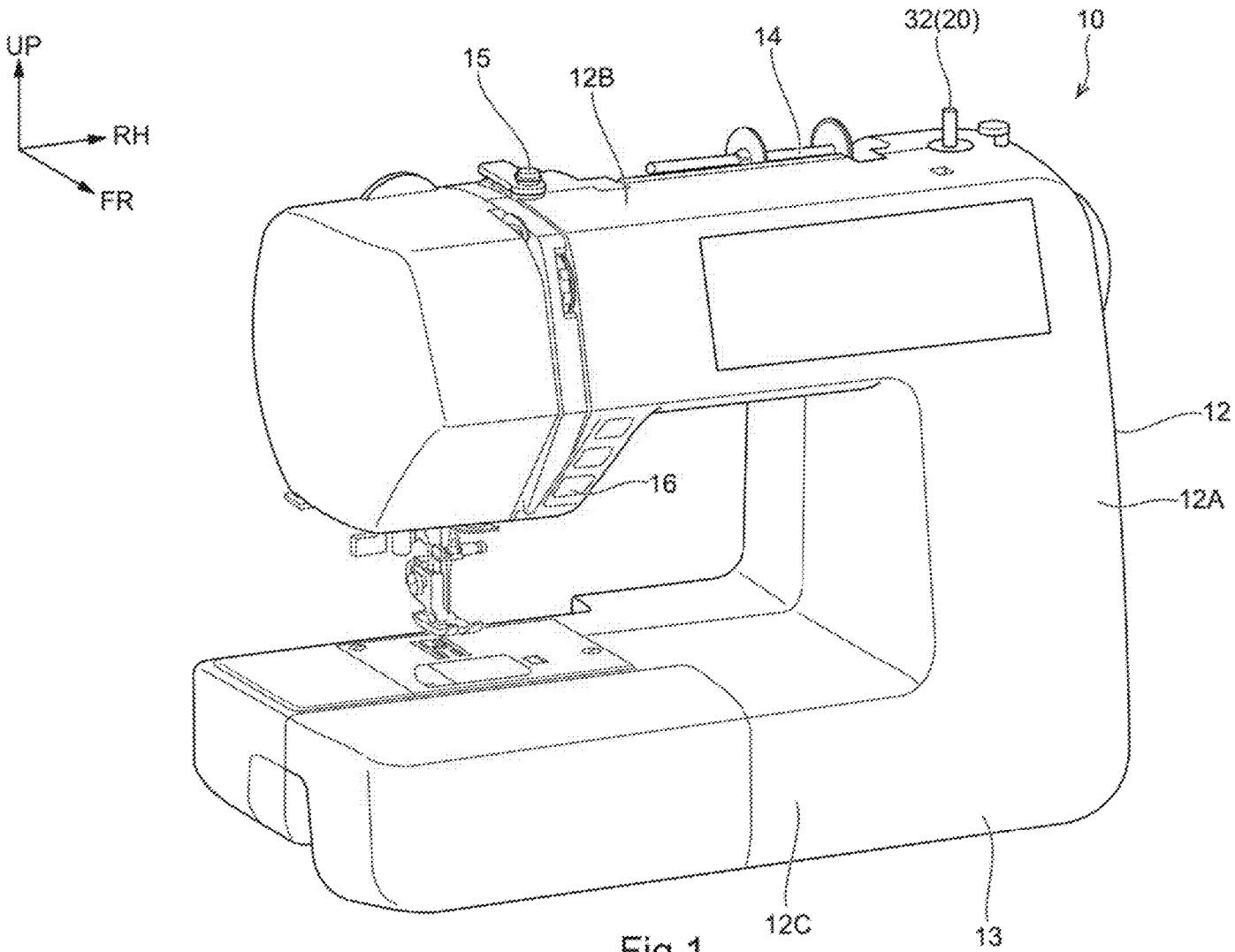
FIG. 1 is a perspective view seen from the diagonally left front which shows the sewing machine to which the bobbin winding device according to this embodiment is applied.

Hereinafter, the sewing machine 10 to which the bobbin winder 20 according to one or more embodiments of the present embodiment will be described with reference to the drawings. The arrows UP, FR, and RH appropriately shown in the drawings indicate the upper side, the front side, and the right side (one side in the width direction) of the sewing machine 10 and the bobbin winding device 20, respectively. Hereinafter, when the description is made using the upper-lower, front-back, and left-right directions, it is assumed that they indicate the upper-lower, front-back, and left-right directions of the sewing machine 10 and the bobbin winding device 20.

As shown in FIG. 1, the sewing machine 10 has a sewing machine main body 12, and the sewing machine main body 12 is formed in a roughly U-shape open to the left side when viewed from the front side. Specifically, the sewing machine main body 12 is configured to include a pedestal portion 12A that constitutes the right end portion of the sewing machine body 12 and extends in the upper-lower direction, an arm portion 12B extending to the left from the upper end portion of the pedestal portion 12A, and a bed portion 12C extending to the left from the lower end of the pedestal portion 12A. Further, a skeleton frame (not shown) constituting the skeleton of the sewing machine main body 12 is provided inside the sewing machine main body 12, and the skeleton frame is covered with a cover 13 constituting the outer shell of the sewing machine main body 12.

A bobbin winding device 20 to be described later is built in the right end portion of the arm portion 12B, and the upper end portion of the spool shaft 32 constituting the bobbin winding device 20 projects upward from the arm portion 12B. The arm portion 12B is provided with a thread stand rod 14 diagonally rearward to the left of the spool shaft 32. A thread top (not shown) around which the bobbin thread is wound is attached to the thread stand rod 14.

Further, the arm portion 12B is provided with a spool guide portion 15 on the left side of the thread stand rod 14. It is configured that the bobbin thread extending from the thread top to the left side is folded back at the spool guide portion 15 and guided to the spool shaft 32 side. Further, an operation button 16 is provided at the left end of the arm portion 12B so that it can be pressed, and a switch (not shown) is pressed by the pressing operation of the operation button 16. The switch is electrically connected to the control unit 70 (see FIG. 4) to output an on/off signal to the control unit 70.

Further, the bobbin winding device 20 of the present embodiment is configured so that the bobbin thread can be wound around three types of bobbins having different forms. Therefore, in the following description, the three types of bobbins will be described, and then the bobbin winding device 20 will be described.

[Configuration of Bobbins]

Figure 2A:
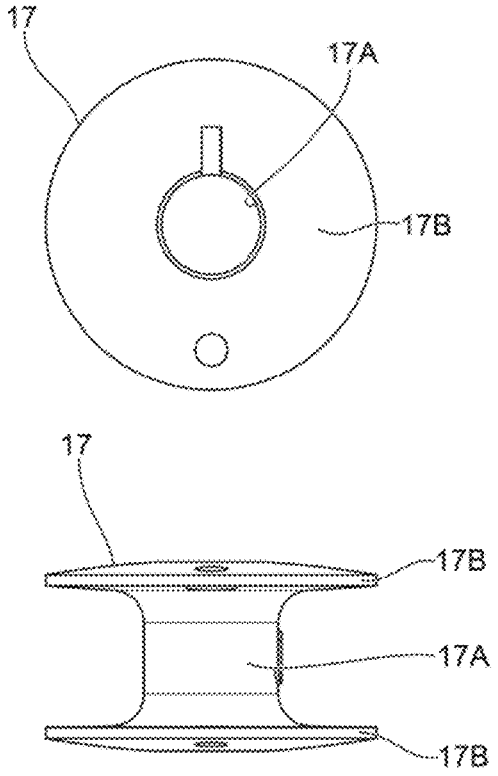
FIG. 2A is a plan view and a side view which shows the small bobbin used for the bobbin winding device according to the present embodiment.
Figure 2B:
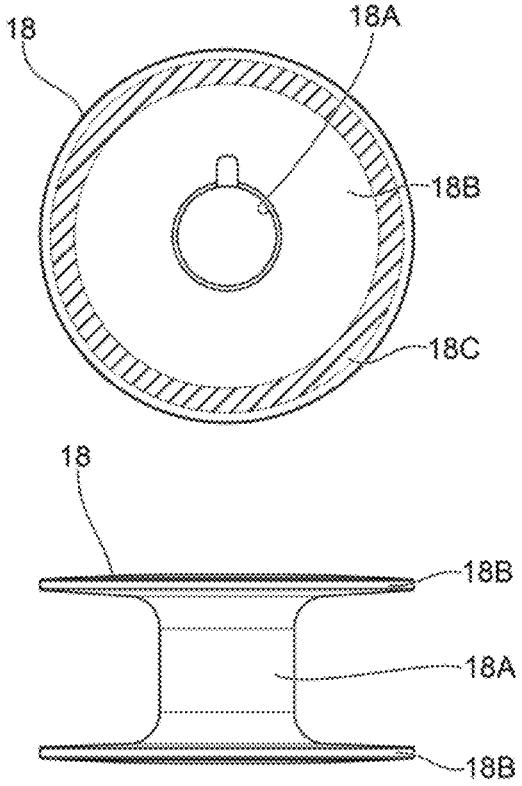
FIG. 2B is a plan view and a side view showing a medium bobbin used in the bobbin winding device according to the present embodiment.
Figure 2C:
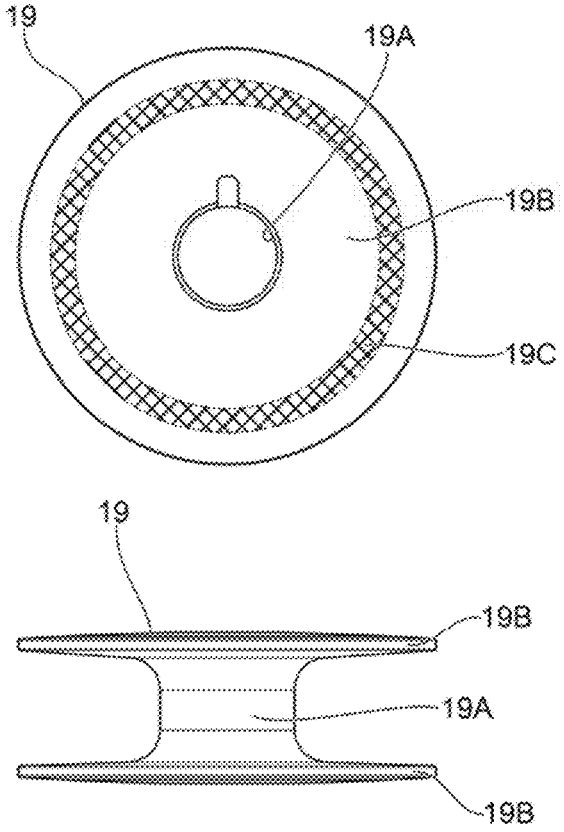
FIG. 2C is a plan view and a side view showing a large bobbin used in the bobbin winding device according to the present embodiment.

As shown in FIG. 2A, FIG. 2B, and FIG. 2C, the bobbin winding device 20 is configured to be able to use three types of bobbins as "bobbins": a small bobbin 17, a medium bobbin 18, and a large bobbin 19. The small bobbin 17 includes a cylindrical core portion 17A and a pair of flange portions 17B protruding outward in the radial direction from both ends in the axial direction of the core portion 17A. Like the small bobbin 17, the medium bobbin 18 includes a cylindrical core portion 18A and a pair of flange portions 18B protruding outward in the axial direction from both ends in the axial direction of the core portion 18A. Further, like the small bobbin 17, the large bobbin 19 includes a cylindrical core portion 19A and a pair of flange portions 19B protruding outward in the axial direction from both ends in the axial direction of the core portion 19A. The diameter of the flange portion 17B of the small bobbin 17 is set to be smaller than the diameter of the flange portion 18B of the medium bobbin 18, and the diameter of the flange portion 18B of the medium bobbin 18 is set to be smaller than the diameter of the flange portion 19B of the large bobbin 19. Further, the thickness dimension (shaft dimension) of the small bobbin 17 and medium bobbin 18 are set to the same thickness dimension, and are set larger than the thickness dimension of the large bobbin 19.

The small bobbin 17, the medium bobbin 18, and the large bobbin 19 are made of a transparent resin material capable of transmitting light. Further, a ring-shaped identification portion 18C (see the hatched parts by oblique lines in FIG. 2B) is formed on the outer peripheral portions of the upper surface and the lower surface of the flange portion 18B of the medium bobbin 18, and the identification portion 18C is printed. Further, a ring-shaped identification portion 19C (see the hatched parts by mesh in FIG. 2C) is formed on the outer peripheral portions of the upper surface and the lower surface of the flange portion 19B of the large bobbin 19, and the identification portion 19C is printed. The identification unit 18C and the identification unit 19C are printed in different colors. Specifically, in the present embodiment, red printing is applied to the identification unit 18C, and blue printing is applied to the identification unit 19C. Further, the diameter dimension and the width dimension of the identification unit 18C and the identification unit 19C are set to be the same. That is, in a plan view, the identification unit 18C and the identification unit 19C are arranged at the same positions with respect to the axes of the medium bobbin 18 and the large bobbin 19.

[Configuration of Bobbin Winding Device 20]

Figure 3:
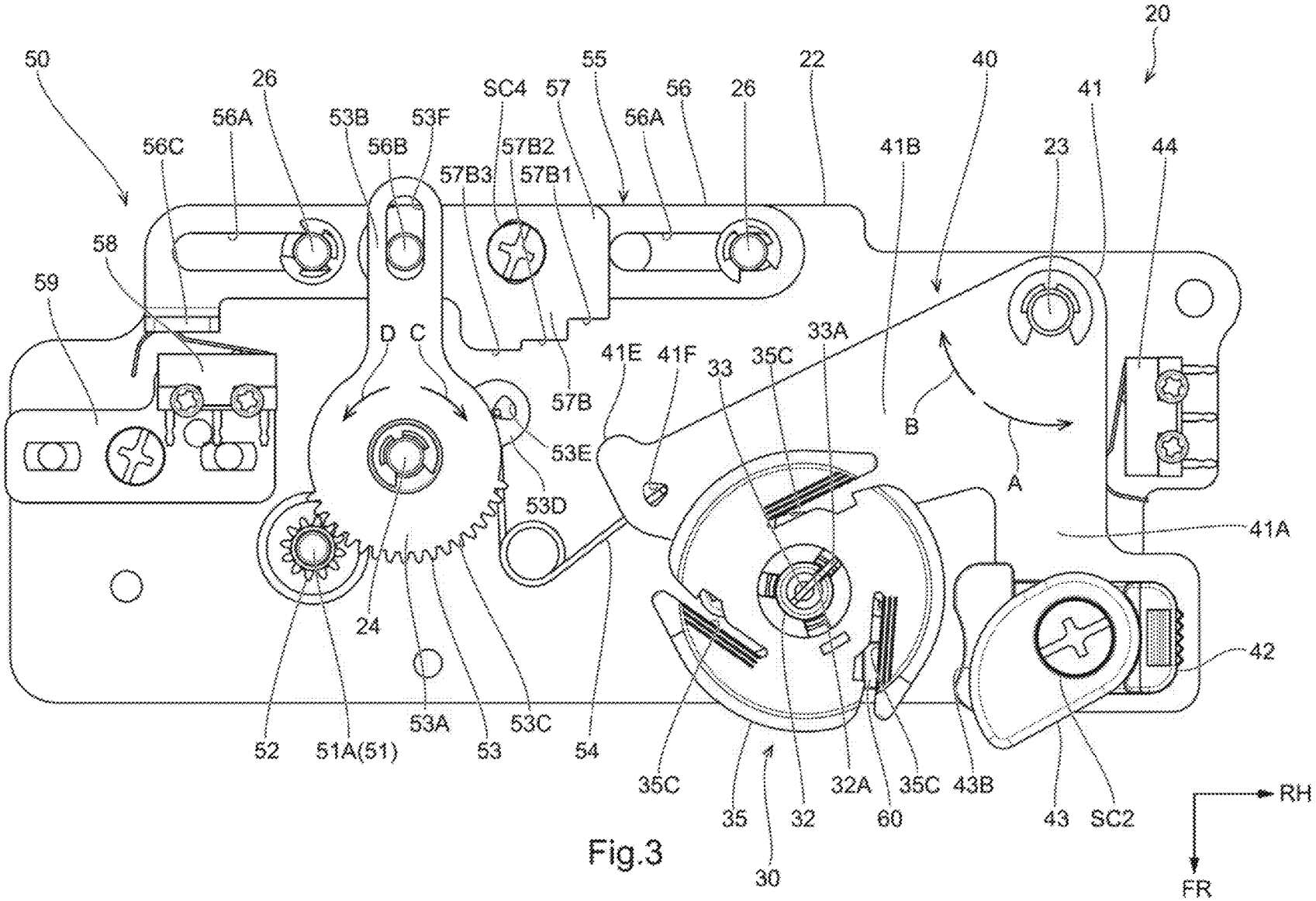
FIG. 3 is a plan view of the bobbin winding device according to the present embodiment as viewed from above.
Figure 4:
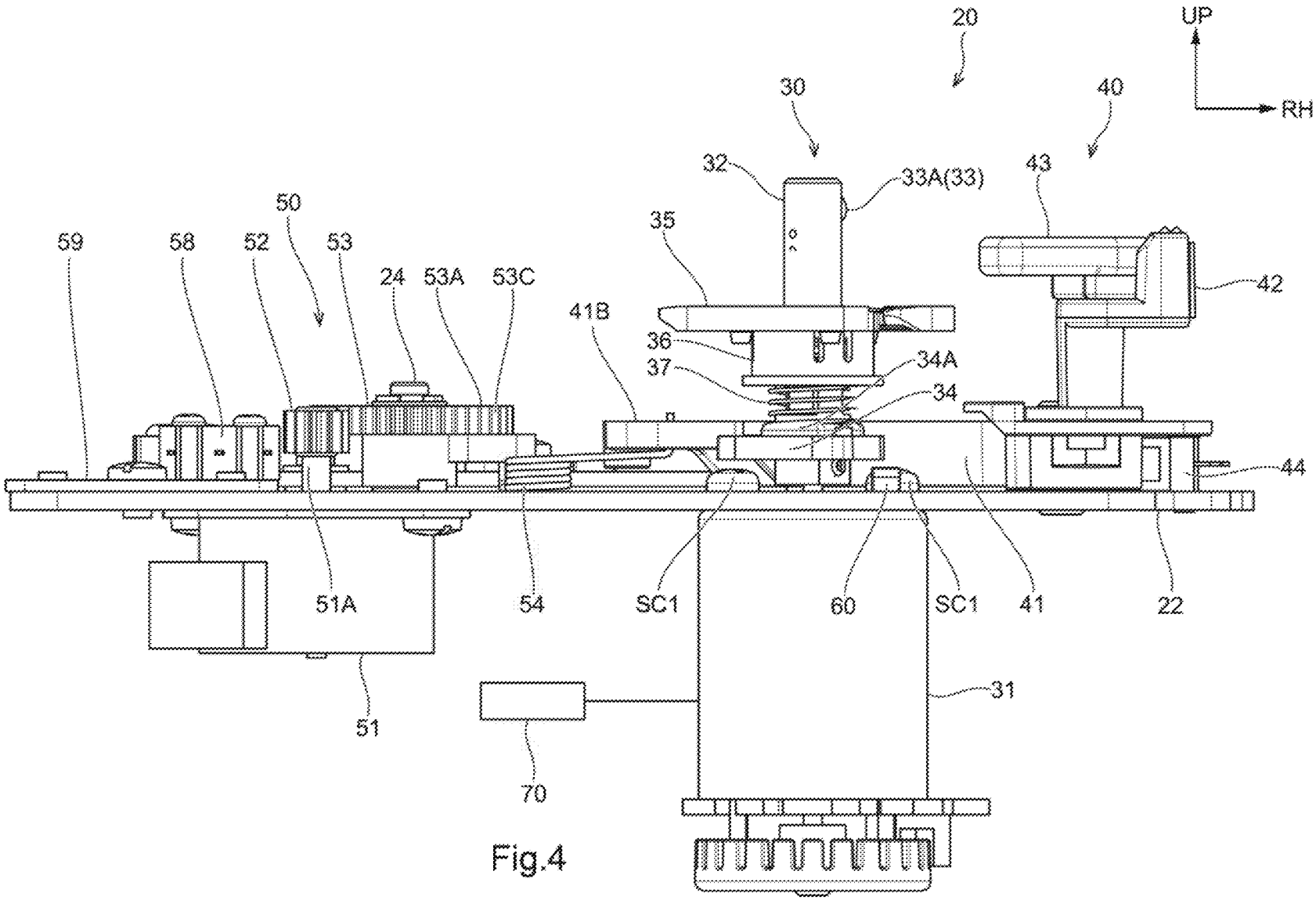
FIG. 4 is a front view of the bobbin winding device shown in FIG. 3 as viewed from the front side.
Figure 5:
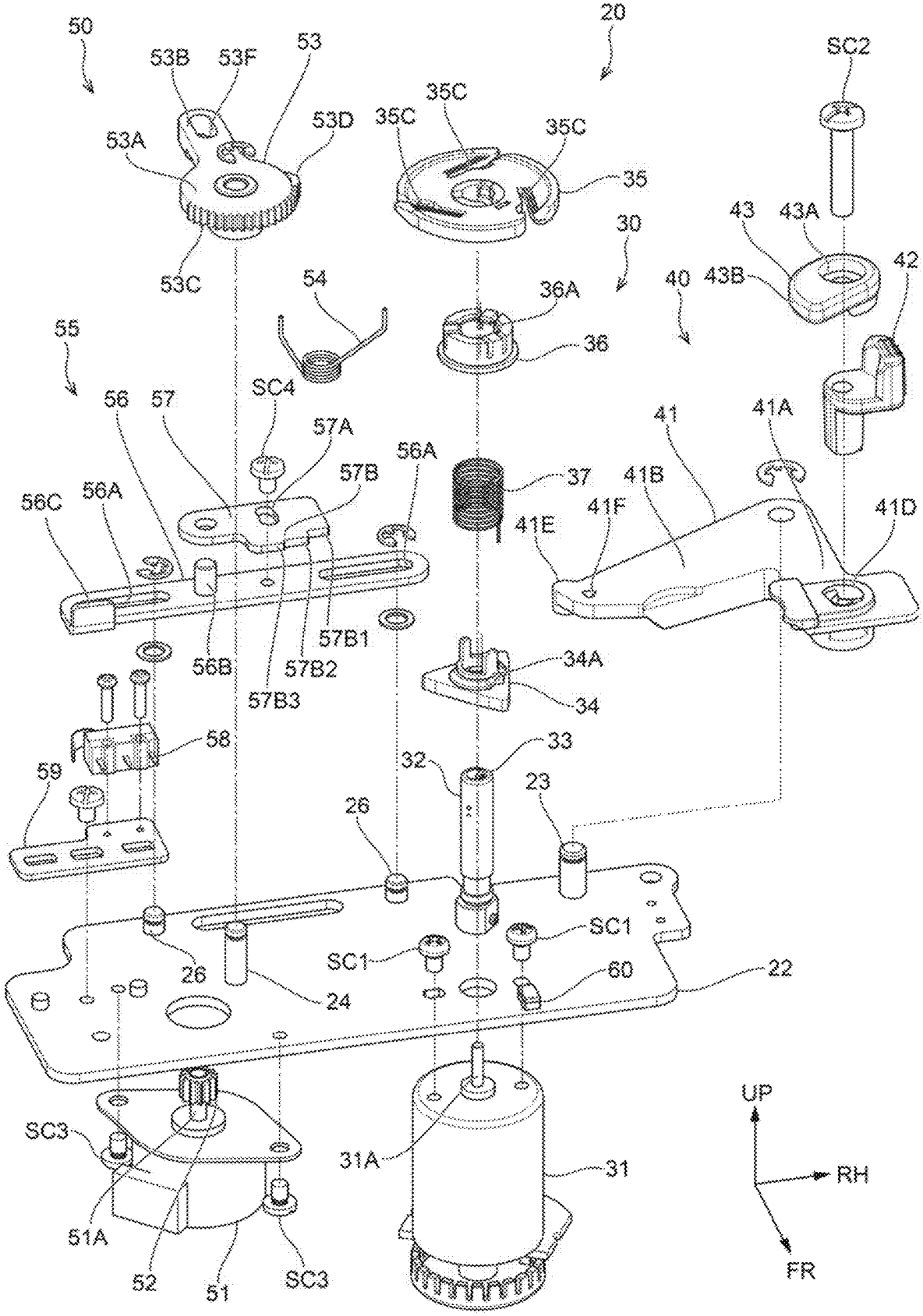
FIG. 5 is an exploded perspective view of the bobbin winding device shown in FIG. 3.

As shown in FIGS. 3 to 5, the bobbin winding device 20 includes a base plate 22, a bobbin winding mechanism unit 30, a bobbin winding detection mechanism unit 40, switching mechanism unit 50, and a color sensor 60 as "outer diameter detector". Hereinafter, each configuration of the bobbin winding device 20 will be described.

[Configuration of Base Plate 22]

The base plate 22 is formed in a roughly rectangular plate shape with the upper-lower direction as the plate thickness direction and the left-right direction as the longitudinal direction. The base plate 22 is built in the right end of the arm portion 12B of the sewing machine main body 12, and is fixed to the skeleton frame of the sewing machine main body 12.

[Configuration of Bobbin Winding Mechanism Unit 30]

As also shown in FIG. 5, the bobbin winding mechanism unit 30 includes a spool motor 31, a spool shaft 32, a triangular cam 34, a thread trimming holder 35, a holder stopper 36, and a holder urging spring 37.

The spool motor 31 has an axial direction in the upper-lower direction and arranged below the base plate 22, and is fastened and fixed to the base plate 22 by screws SC1. The output shaft 31A of the spool motor 31 projects upward from the base plate 22. The spool motor 31 is electrically connected to the control unit 70 and is configured to be driven by the control unit 70.

The spool shaft 32 is formed in a roughly cylindrical shape with the upper-lower direction as the axial direction. And the upper end of the output shaft 31A of the spool motor 31 is fitted into the lower end of the spool shaft 32, and the spool shaft 32 is integrally rotatably connected to the output shaft 31A. A bobbin stopper 33 (in a broad sense, it is an element understood as an "engaging member"; see FIG. 6A and FIG. 6B) is provided inside the upper portion of the spool shaft 32. The bobbin stopper 33 is configured as a bar spring and is bent in a roughly U-shape open upward in a side view. One end of the bobbin stopper 33 is locked to the spool shaft 32, and the other end of the bobbin stopper 33 is arranged in the slit 32A formed on the spool shaft 32. As a result, the bobbin stopper 33 is configured to be elastically deformable in the radial direction of the spool shaft 32. An engaging hook 33A (in a broad sense, it is an element understood as an "engaging portion") is formed at the other end of the bobbin stopper 33. The engaging hook 33A is bent in a roughly U shape and protrudes outward from the slit 32A in the radial direction of the spool shaft 32.

The triangular cam 34 is formed in a roughly triangular plate shape with the upper-lower direction as the plate thickness direction. A mounting cylinder portion 34A is formed at a roughly central portion of the triangular cam 34, and the mounting cylinder portion 34A is formed in a cylindrical shape with the upper-lower direction as the axial direction. The mounting cylinder portion 34A projects upward from the triangular cam 34, and the inside of the mounting cylinder portion 34A penetrates in the upper-lower direction. And the lower end portion of the spool shaft 32 is fitted into the mounting cylinder portion 34A, and the triangular cam 34 is integrally rotatably connected to the lower end portion of the spool shaft 32.

The thread trimming holder 35 is formed in a roughly disk shape with the upper-lower direction as the plate thickness direction. A mounting portion 35A projecting downward is formed in the central portion of the thread trimming holder 35, and the mounting portion 35A is formed in a roughly cylindrical shape with the upper-lower direction as the axial direction. The spool shaft 32 is inserted into the mounting portion 35A of the thread trimming holder 35, and the thread trimming holder 35 is arranged below the engaging hook 33A of the bobbin stopper 33 (one side in the axial direction of spool shaft 32) and above the triangular cam 34. Further, the mounting portion 35A is connected to the spool shaft 32 so as to be integrally rotatable and relatively movable in the axial direction. Specifically, the thread trimming holder 35 is configured to be movable between a raised position as a "first position" (the position shown in FIG. 6B) and a lowered position as a "second position" (the position shown in FIG. 6A) lowered from the raised position. Further, a hook portion 35B (see FIG. 6A and FIG. 6B) is formed at the lower end portion of the mounting portion 35A, and the hook portion 35B engages with the spool shaft 32 to restrict the movement of the thread trimming holder 35 to the upper side in the raised position.

Further, three thread trimming slits 35C are formed on the outer peripheral portion of the thread trimming holder 35. The thread trimming slit 35C extends in a direction roughly orthogonal to the radial direction of the thread trimming holder 35, and one end of the thread trimming slit 35C is opened at the outer peripheral portion of the thread trimming holder 35. Further, the thread trimming slits 35C are arranged every 120 degrees in the circumferential direction of the thread trimming holder 35 corresponding to the outer shape of the triangular cam 34. Specifically, the thread trimming slit 35C is arranged at a position that does not overlap with the triangular cam 34 in the upper-lower direction.

The holder stopper 36 is formed in a roughly bottomed cylindrical shape that is open downward. An insertion hole 36A is formed through the upper wall of the holder stopper 36. With the spool shaft 32 inserted into the insertion hole 36A, the holder stopper 36 is arranged on the outer side in the radial direction of the mounting portion 35A of the thread trimming holder 35. Further, the upper end portion of the holder stopper 36 is fixed to the mounting portion 35A of the thread trimming holder 35 by claw fitting. As a result, the thread trimming holder 35 and the holder stopper 36 are connected so as to be integrally movable.

The holder urging spring 37 is configured as a compression coil spring. The holder urging spring 37 is mounted on the mounting cylinder portion 34A of the triangular cam 34 and the mounting portion 35A of the thread trimming holder 35 in a state of being housed in the holder stopper 36. Specifically, the lower end of the holder urging spring 37 is locked to the triangular cam 34, and the upper end of the holder urging spring 37 is locked to the upper wall of the holder stopper 36. As a result, the holder stopper 36 is held in the raised position by the upward urging force of the holder urging spring 37.

Figure 6A:
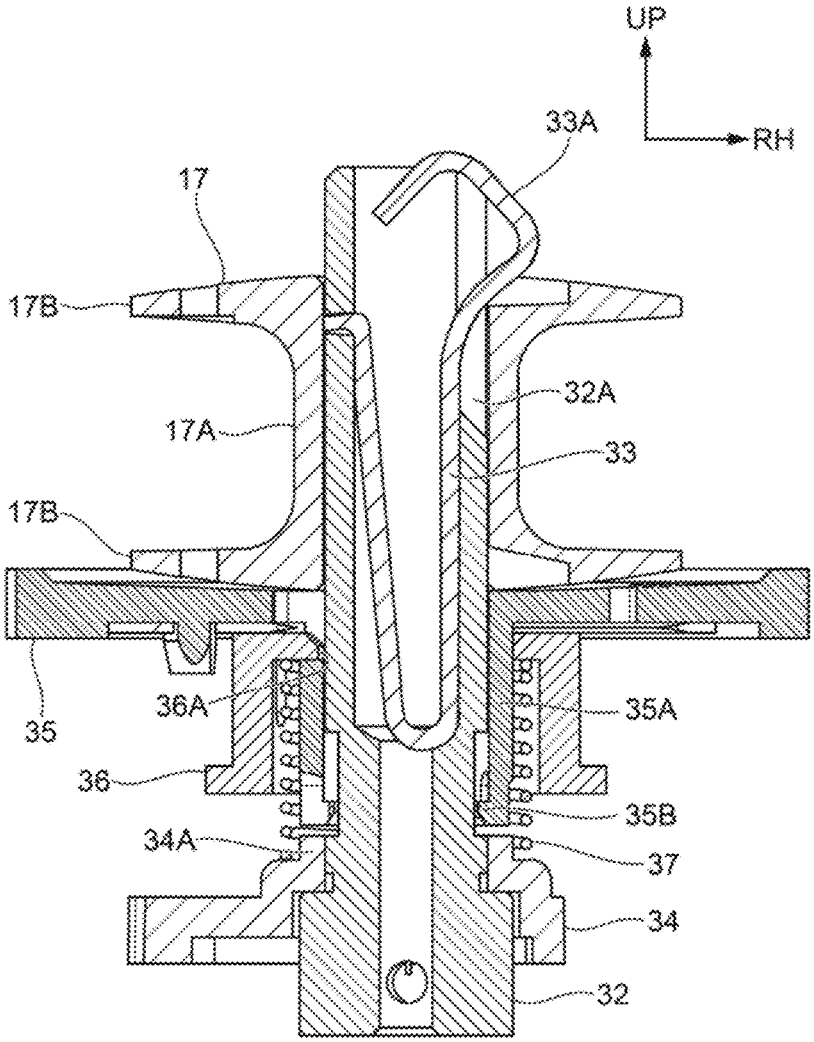
FIG. 6A is a vertical cross-sectional view showing a state in which a small bobbin is attached to the upper end of the spool shaft shown in FIG. 3.
Figure 6B:
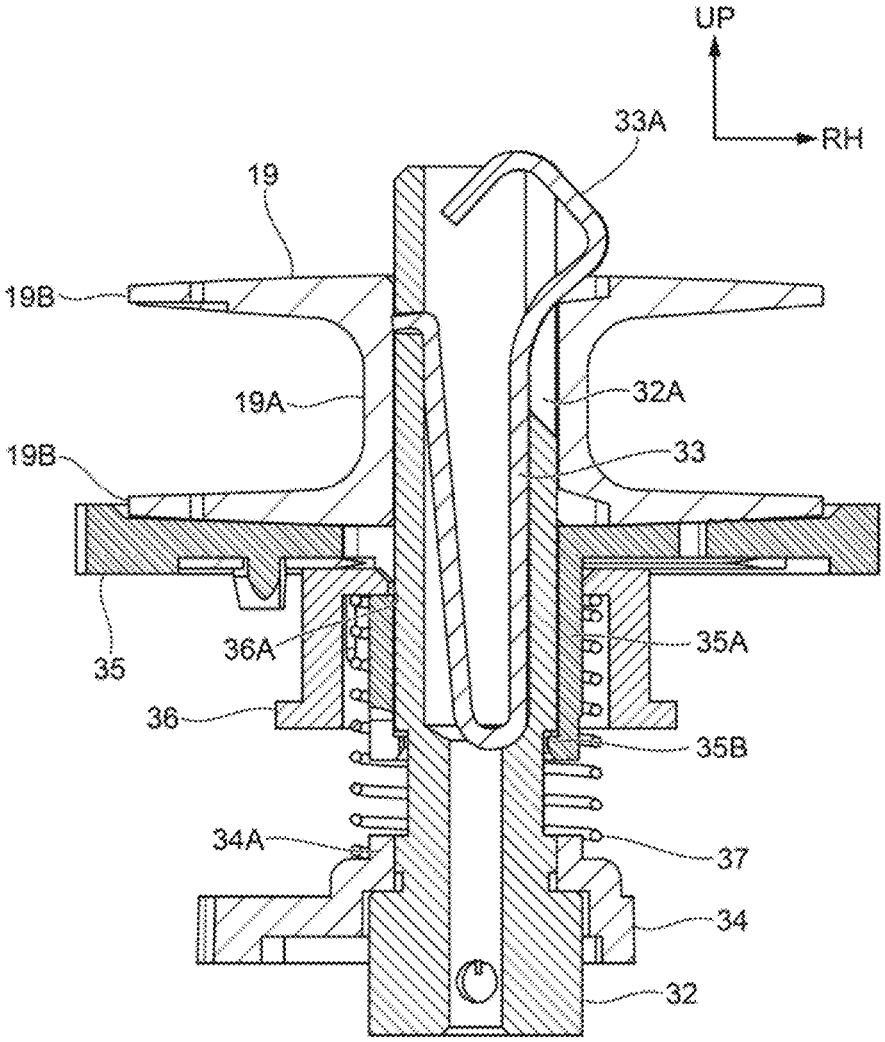
FIG. 6B is a vertical cross-sectional view showing a state in which a large bobbin is attached to the upper end of the spool shaft shown in FIG. 3.

Further, in the mounted state of the small bobbin 17 (medium bobbin 18) on the spool shaft 32, the spool shaft 32 is inserted into the core portion 17A (core portion 18A) of the small bobbin 17 (medium bobbin 18), and the small bobbin (medium bobbin 18) is arranged adjacent to the upper side of the thread trimming holder 35 in the lowered position, and the engaging hook 33A of the bobbin stopper 33 engages with the upper end of the core portion 17A (core portion 18A) of the small bobbin 17 (medium bobbin 18) (see FIG. 6A). On the other hand, in the mounted state of the large bobbin 19 on the spool shaft 32, the spool shaft 32 is inserted into the core portion 19A of the large bobbin 19, and the large bobbin 19 is arranged adjacent to the upper side of the thread trimming holder 35 in the raised position and the engaging hook 33A of the bobbin stopper 33 engages with the upper end portion of the core portion 19A of the large bobbin 19 (see FIG. 6B). As a result, the engaging hook 33A and the thread trimming holder 35 holds the small bobbin 17 (medium bobbin 18) and the large bobbin 19 mounted on the spool shaft 32 by sandwiching them in the upper-lower direction. Therefore, when the spool shaft 32 rotates, the small bobbin 17, the medium bobbin 18, and the large bobbin 19 are prevented from idling, and the small bobbin 17, the medium bobbin 18, and the large bobbin 19 rotate together with the spool shaft 32.

[Configuration of Bobbin Winding Detection Mechanism Unit 40]

As shown in FIGS. 3 to 5, the bobbin winding detection mechanism unit 40 includes a detection lever 41 as a "rotating body", a lever operation portion 42, a lever contact 43 as a "contact portion", and a detection switch 44 as a "switch".

<Configuration of Detection Lever 41>

The detection lever 41 is formed in a roughly V-shaped plate shape with the upper-lower direction as the plate thickness direction, and is configured to include a first lever arm 41A extending roughly in the front-rear direction, a second lever arm 41B extending diagonally forward to the left from the rear end portion of the first lever arm 41A. The detection lever 41 is arranged on the upper side of the base plate 22 and diagonally to the right rear side of the bobbin winding mechanism unit 30 so that the bobbin winding mechanism unit 30 is arranged between the first lever arm 41A and the second lever arm 41B.

Further, the rear end portion of the first lever arm 41A of the detection lever 41 is rotatably supported by the first shaft 23, and the first shaft 23 is formed in a roughly cylindrical shape with the upper-lower direction as the axial direction and protrudes upward from the base plate 22. Specifically, the detection lever 41 is configured to be rotatable between the non-pressing position (position shown in FIG. 7) and the pressing position (position shown in FIG. 3) rotated from the non-pressing position to one side in the rotation direction (the side in the direction of arrow A in FIG. 7). Further, the switching mechanism unit 50, which will be described later, changes the non-pressing position of the detection lever 41 to one side in the rotation direction.

As shown in FIG. 5, a fitting hole 41D into which a lever operation portion 42, which will be described later, is fitted is formed in the front end portion of the first lever arm 41A. Further, as shown in FIG. 3, a lever protrusion 41E, which protrudes toward the other direction in the rotation direction of the detection lever 41 (the side in the direction of arrow B in FIG. 3), is provided at the tip of the second lever arm 41B. Further, a locking hole 41F for locking the switching spring 54, which will be described later, is formed through the tip of the second lever arm 41B.

<Configuration of Lever Operation Portion 42>

The lever operating portion 42 is formed in a roughly crank shape when viewed from the front side. The lower portion of the lever operating portion 42 is fitted into the fitting hole 41D of the detection lever 41, and the lever operating portion 42 is fixed to the detection lever 41.

<Configuration of Lever Contact 43>

The lever contact 43 is formed in a roughly elliptical plate shape with the upper-lower direction as the plate thickness direction, and is arranged on the upper side of the lower portion of the lever operating portion 42. A fixing hole 43A is formed through one end of the lever contact 43. The screw SC2 is inserted into the fixing hole 43A and screwed into the female screw of the lever operating portion 42, and the lever contact 43 is fixed to the lever operating portion 42 by the screw SC2. As a result, the lever contact 43 is configured to be integrally rotatable with the detection lever 41, and is arranged on one side in the rotation direction of the detection lever 41 with respect to the spool shaft 32.

A contact portion 43B is formed at the other end of the lever contact 43, and the contact portion 43B is curved in an arc shape that is convex toward the other side in the rotation direction of the detection lever 41 in a plan view. The contact portion 43B and the spool shaft 32 are arranged so as to face each other with a predetermined interval in the rotation direction of the detection lever 41.

At the non-pressing position of the detection lever 41, a part of the contact portion 43B of the lever contact 43 is inserted into the small bobbin 17, the medium bobbin 18, and the large bobbin 19 mounted on the spool shaft 32. On the other hand, at the pressing position of the detection lever 41, the large bobbin 19 mounted on the spool shaft 32 and the lever contact 43 are set so as not to overlap in a plan view. That is, at the pressing position of the detection lever 41, the small bobbin 17, the medium bobbin 18, and the large bobbin 19 and the lever contact 43 do not interfere with each other when the small bobbin 17, the medium bobbin 18, and the large bobbin 19 are attached/detached. Further, as will be described in detail later, when the bobbin thread is wound around the small bobbin 17, the medium bobbin 18, and the large bobbin 19, the wound bobbin thread abuts on the contact portion 43B and presses the contact portion 43B to one side in the rotation direction of the detection lever 41.

<Configuration of Detection Switch 44>

Figure 7:
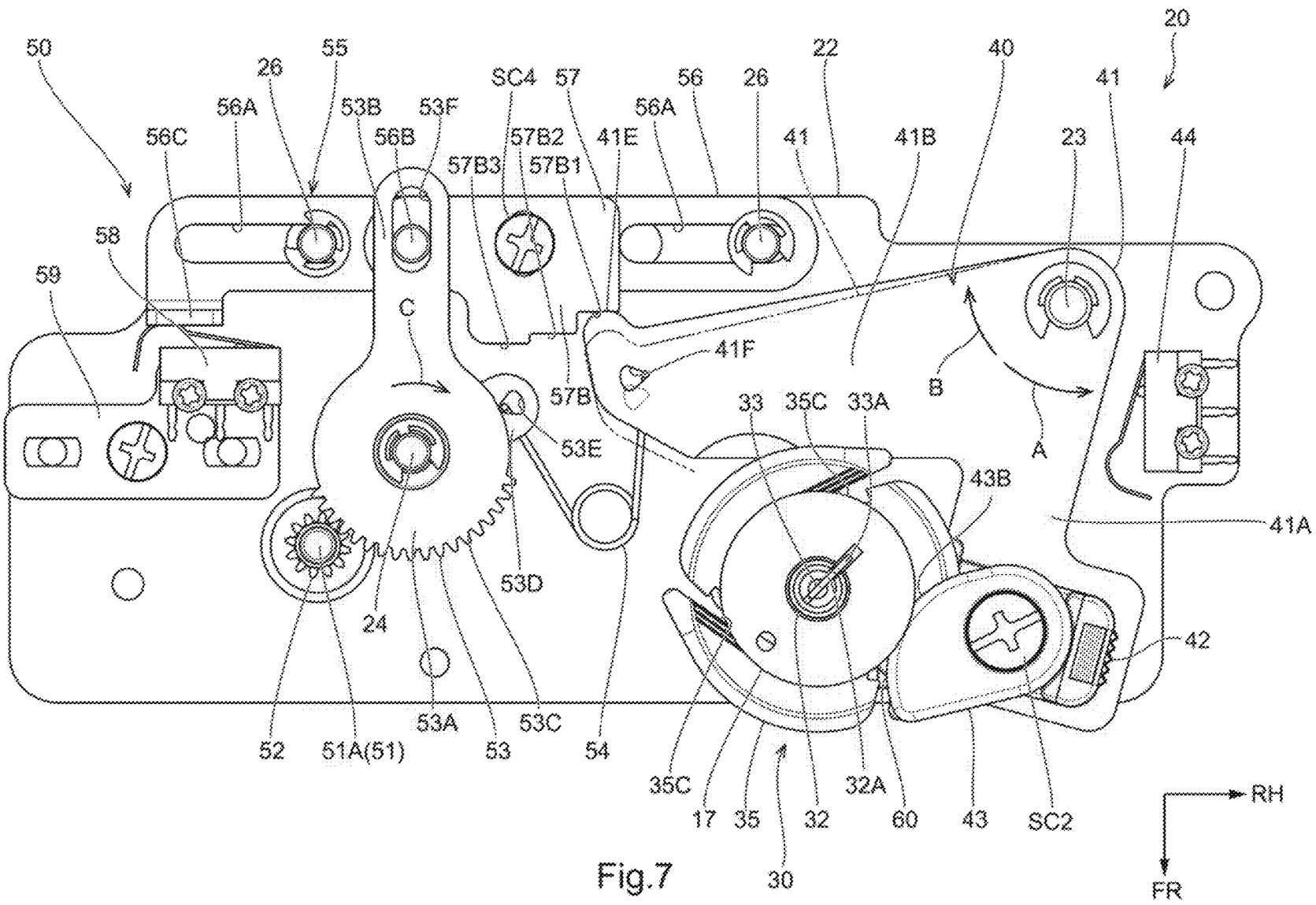
FIG. 7 is a plan view showing the state where the detection lever is rotated to the non-pressing position in the small bobbin mode.

As shown in FIGS. 3 and 7, the detection switch 44 is arranged on the right side of the detection lever 41 and fixed to the base plate 22. The detection switch 44 is configured as a lever type switch. It is configured that at the non-pressed position of the detection lever 41, the lever portion of the detection switch 44 is in the non-pressed state, and at the pressed position of the detection lever 41, the lever portion of the detection switch 44 is pressed by the detection lever 41. Further, the detection switch 44 is electrically connected to the control unit 70, and outputs an on/off signal to the control unit 70.

[Configuration of Switching Mechanism Unit 50]

The switching mechanism unit 50 is configured as a mechanism unit for switching the mode of the bobbin winding device 20 in response to the bobbin mounted on the spool shaft 32. Specifically, the switching mechanism unit 50 is configured as a mechanism unit that switches the bobbin winding device 20 to any of a small bobbin mode, a medium bobbin mode, and a large bobbin mode. As shown in FIGS. 3 to 5, the switching mechanism unit 50 includes a switching motor 51 as a "motor", a switching lever 53 as a "switching member", a switching spring 54 as the "urging member", an slide unit 55 as the "position changing member", and a switching switch 58.

<Configuration of Switching Motor 51>

The switching motor 51 is arranged on the lower side of the base plate 22 and on the left side of the bobbin winding mechanism unit 30 and the detection lever 41 with the upper-lower direction as the axial direction, and is fastened and fixed to the base plate 22 by the screw SC3. The output shaft 51A of the switching motor 51 projects upward from the base plate 22. A pinion gear 52 is provided on the output shaft 51A so as to be integrally rotatable. The switching motor 51 is electrically connected to the control unit 70 and is configured to be driven by the control unit 70.

<Configuration of Switching Lever 53>

The switching lever 53 is formed in a plate shape with the upper-lower direction as the plate thickness direction, and is arranged on the diagonally right rear side of the pinion gear 52. Specifically, the switching lever 53 includes a roughly disk-shaped lever main body 53A and a lever connecting portion 53B extending rearward from the outer peripheral portion of the lever main body 53A. The central portion of the lever body 53A is rotatably supported by the second shaft 24, and the second shaft 24 is formed in a columnar shape with the upper-lower direction as the axial direction and protrudes upward from the base plate 22. A switching gear portion 53C is formed on the outer peripheral portion of the front portion of the lever body 53A, and the switching gear portion 53C is meshed with the pinion gear 52. As a result, when the switching motor 51 is driven, the switching lever 53 rotates around the axis of the second shaft 24. Specifically, in the small bobbin mode, the switching lever 53 is arranged at the initial position (position shown in FIG. 7), in the medium bobbin mode, the switching lever 53 is arranged at the first switching position (position shown in FIG. 8) rotated from the initial position to one side in the rotation direction (arrow C direction side in FIG. 7), and in the large bobbin mode, the switching lever 53 is arranged at the second switching position (position shown in FIG. 9), which is further rotated from the first switching position to one side in the rotation direction.

The switching lever 53 has a locking portion 53D for locking the end portion of the switching spring 54, which will be described later. The locking portion 53D projects obliquely to the right and rearward from the outer peripheral portion of the lever body 53A. A locking hole 53E is formed through the tip of the locking portion 53D. Further, a connecting hole 53F is formed through the lever connecting portion 53B. The connecting hole 53F is formed in an oblong hole shape along the longitudinal direction of the lever connecting portion 53B.

<Configuration of Switching Spring 54>

The switching spring 54 is configured as a torsion spring. One end of the switching spring 54 is inserted into the locking hole 53E of the switching lever 53 and locked to the locking portion 53D, and the other end of the switching spring 54 is inserted into the locking hole 41F of the detection lever 41 and locked to the tip of the second lever arm 41B. The switching spring 54 urges the detection lever 41 in the rotation direction. Specifically, the switching spring 54 is configured to urge the detection lever 41 to the other side in the rotation direction (arrow B direction side in FIG. 7) at the non-pressing position of the detection lever 41, and to urge the detection lever 41 to one side in the rotation direction at the pressing position of the detection lever 41. That is, the urging direction of the switching spring with respect to the detection lever 41 is switched at an intermediate position (position indicated by two-dot chain line in FIG. 7) between the non-pressing position and the pressing position of the detection lever 41.

<Configuration of Slide Unit 55>

As shown in FIGS. 3, 5, and 7 to 9, the slide unit 55 includes a slide member 56 and an adjusting plate 57.

The slide member 56 is formed in a roughly long plate shape having an upper-lower direction as a plate thickness direction and extending in the left-right direction. A pair of slide holes 56A are formed through the slide members 56 at both ends in the longitudinal direction, and the slide holes 56A are formed in an oblong hole shape with the left-right direction as the longitudinal direction. A support pin 26 provided on the base plate 22 is inserted into the slide hole 56A, and the slide member 56 is connected to the base plate 22 so that it can slide in the left-right direction.

A connecting pin 56B is provided at the intermediate portion in the longitudinal direction of the slide member 56. The connecting pin 56B is formed in a roughly columnar shape with the upper-lower direction as the axial direction, and projects upward from the slide member 56. The connecting pin 56B is inserted into the connecting hole 53F of the switching lever 53 described above so as to be relatively movable. As a result, the slide member 56 is connected to the switching lever 53 and slides in the left-right direction in conjunction with the rotation of the switching lever 53. Specifically, it is set that at the initial position of the switching lever 53, the slide member 56 is arranged at the non-operating position (position shown in FIGS. 3 and 7), at the first switching position of the switching lever 53, the slide member 56 is arranged at the first slide position (position shown in FIG. 8), and at the second switching position of the switching lever 53, the slide member 56 is arranged at the second slide position (position shown in FIG. 9). Further, at the left end portion of the slide member 56, a switch pressing portion 56C bent upward at the front end portion is formed.

The adjusting plate 57 is formed in a roughly rectangular plate shape with the upper-lower direction being the plate thickness direction and the left-right direction being the longitudinal direction. The adjusting plate 57 is arranged on the upper side of the slide member 56, and the left end portion of the adjusting plate 57 is rotatably supported by the connecting pin 56B. A fixing hole 57A is formed through the right end of the adjusting plate 57, and the fixing hole 57A is formed in an oblong hole shape with the rotation direction of the adjusting plate 57 as the longitudinal direction. The adjusting plate 57 is fastened and fixed to the slide member 56 by the screw SC4 inserted through the fixing hole 57A.

An adjusting portion 57B projecting to the front side is formed at the front end portion of the right portion of the adjusting plate 57. The adjusting portion 57B is formed in a three-step stepped shape. Specifically, the adjusting unit 57B is configured to include a first adjusting portion 57B1 that constitutes a right end portion of the adjusting unit 57B, a second adjusting portion 57B2 that constitutes the intermediate portion in the left-right direction of the adjusting portion 57B and protrudes forward from the first adjusting portion 57B1, and a third adjusting portion 57B3 that constitutes the left end portion of the adjusting portion 57B and protrudes forward from the second adjusting portion 57B2.

In the initial position of the switching lever 53 (small bobbin mode), the lever protrusion 41E of the detection lever 41 in the non-pressing position comes into contact with the first adjustment portion 57B1 of the adjustment plate 57 (see FIG. 7). It is configured that at the first switching position of the switching lever 53 (medium bobbin mode), the lever protrusion 41E of the detection lever 41 in the non-pressing position comes into contact with the second adjusting portion 57B2, and the non-pressing position of the detection lever 41 is changed to one side in the rotation direction (see FIG. 8). Further, it is configured that at the second switching position of the switching lever 53 (large bobbin mode), the lever protrusion 41E of the detection lever 41 in the non-pressing position comes into contact with the third adjusting portion 57B3, and the non-pressing position of the detection lever 41 is further changed to one side in the rotation direction (see FIG. 9). Further, even in the medium bobbin mode and the large bobbin mode, the switching spring 54 is configured to urge the detection lever 41 to the other side in the rotation direction at the non-pressing position of the detection lever 41.

Figure 8:
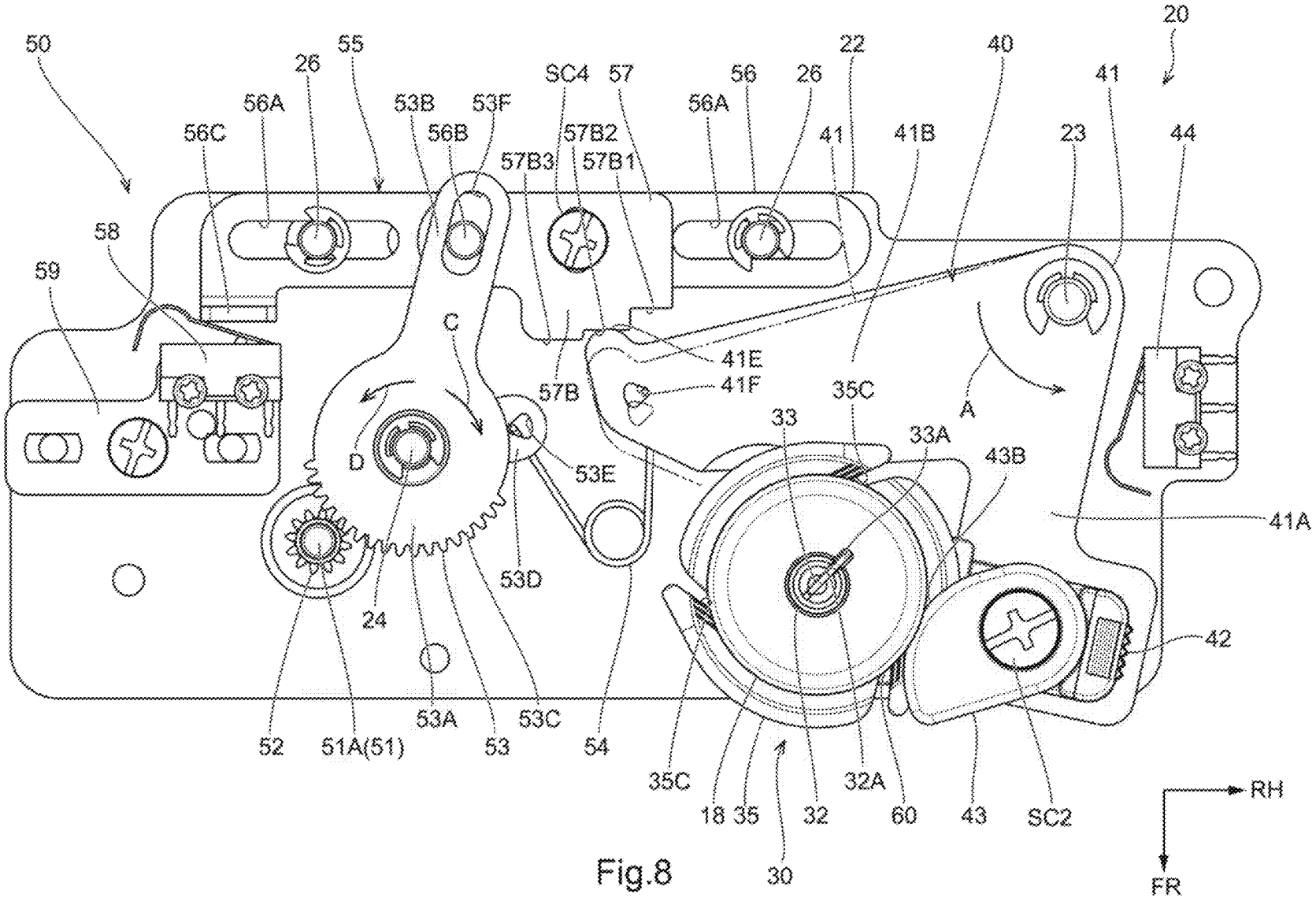
FIG. 8 is a plan view showing the state where the detection lever is rotated to the non-pressing position in the medium bobbin mode.

As shown in FIG. 8, in the medium bobbin mode, the position of the switching spring 54 in the non-pressing position of the detection lever 41 is displaced to one side in the rotation direction of the switching lever 53 and one side in the rotation direction of the detection lever 41 as compared with the small bobbin mode. Therefore, in the medium bobbin mode, the intermediate position of the detection lever 41 is changed to one side in the rotation direction of the detection lever 41 as compared with the small bobbin mode.

Figure 9:
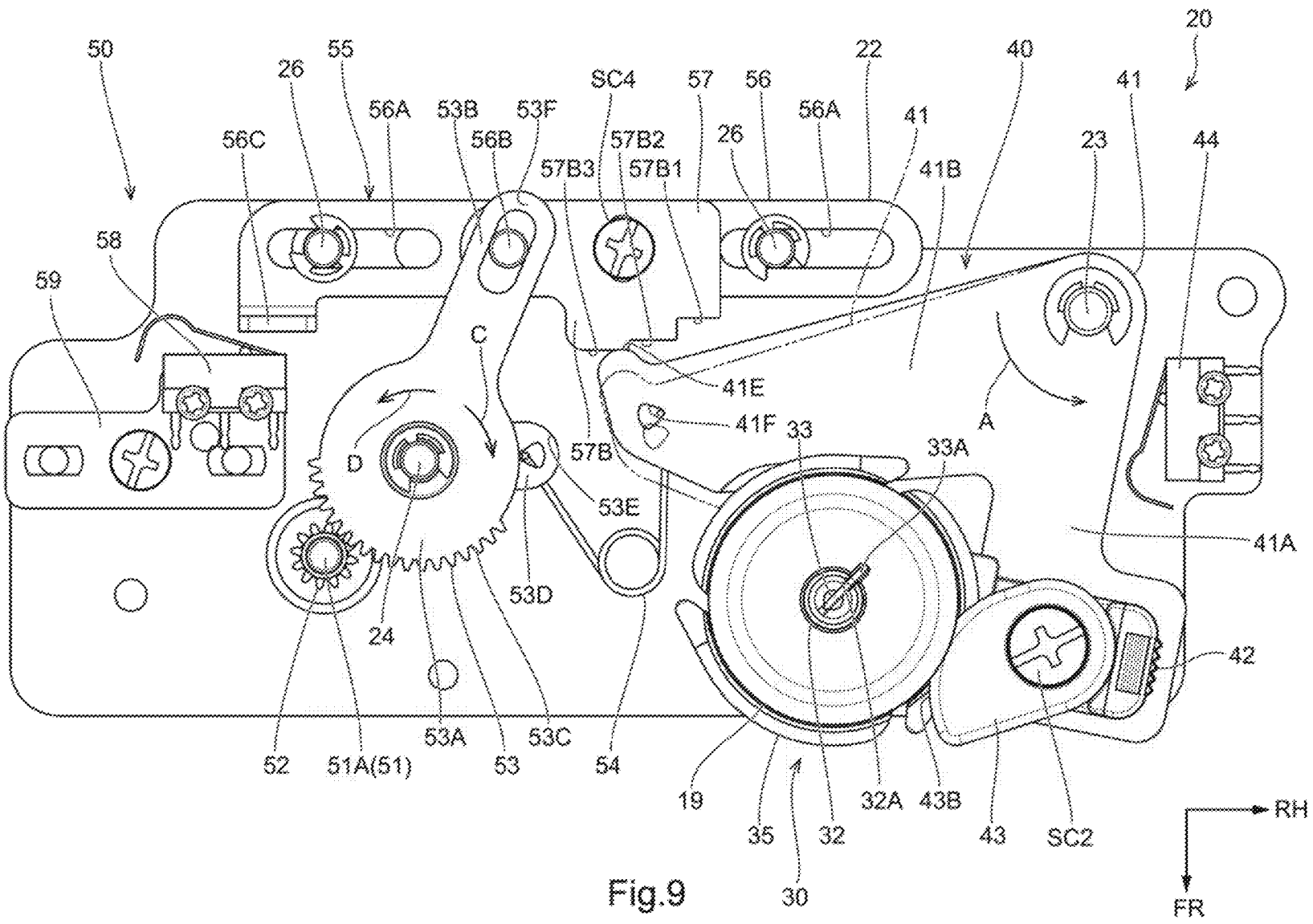
FIG. 9 is a plan view showing the state where the detection lever is rotated to the non-pressing position in the large bobbin mode.

Further, as shown in FIG. 9, in the large bobbin mode, the position of the switching spring 54 in the non-pressing position of the detection lever 41 is further displaced to one side in the rotation direction of the switching lever 53 and one side in the rotation direction of the detection lever 41, as compared with the medium bobbin mode. Therefore, in the large bobbin mode, the intermediate position of the detection lever 41 is changed to one side in the rotation direction of the detection lever 41 as compared with the medium bobbin mode.

<Configuration of Switching Switch 58>

The switching switch 58 is arranged on the front side of the switch pressing portion 56C of the slide member 56, and is fixed to the base plate 22 via the switch holder 59. The switching switch 58 is configured as a lever type switch like the detection lever 41. It is set that at the initial position of the switching lever 53 (non-operating position of slide member 56), the lever portion of the switching switch 58 is pressed by the switch pressing portion 56C, and at the first switching position and the second switching position of the switching lever 53 (1st slide position and 2nd slide position of slide member 56), the lever portion of the switching switch is not pressed. Further, the switching switch 58 is electrically connected to the control unit 70, and outputs an on/off signal to the control unit 70.

(Configuration of Color Sensor 60)

Figure 10:
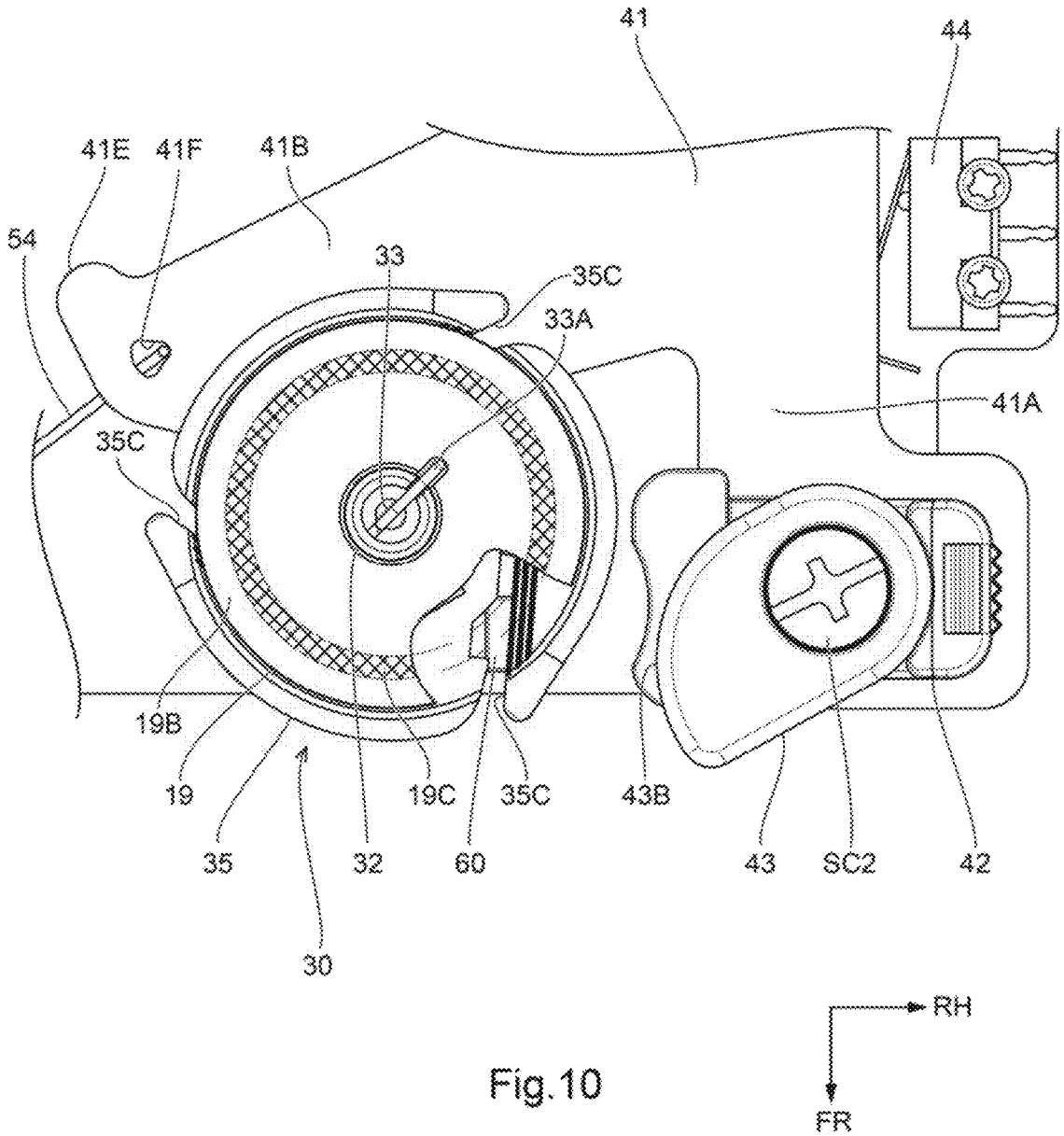
FIG. 10 is a plan view of a partially broken bobbin for explaining the positional relationship between the color sensor, the thread trimmer holder, and the bobbin shown in FIG. 5.

As shown in FIGS. 3, 5, and 10, the color sensor 60 is fixed to the upper surface of the base plate 22 and is arranged below the outer peripheral portion of the thread trimming holder 35. Specifically, in the non-operating state of the spool motor 31, the color sensor 60 is arranged below the thread trimming slit 35C of any of the thread trimming holders 35. The color sensor 60 has a light projecting unit (not shown), and irradiates light upward from the light projecting unit. Specifically, the light from the light projecting portion passes through the thread trimming slit 35C of the thread trimming holder 35 and irradiates the flange portion 17B of the small bobbin 17, identification unit 18C of the medium bobbin 18, and identification unit 19C of the large bobbin 19 on the thread trimming holder 35. Further, the color sensor 60 has a light receiving portion (not shown), and receives the light reflected from the flange portion 17B of the small bobbin 17, identification unit 18C of the medium bobbin 18, and identification unit 19C of the large bobbin 19. The color sensor 60 detects whether the bobbin mounted on the spool shaft 32 is one of the small bobbin 17, the medium bobbin 18, or the large bobbin 19 based on the color component of the received light. That is, the color sensor 60 detects the outer diameter of the bobbin mounted on the spool shaft 32 based on the color component of the received light.

(Configuration of Control Unit 70)

The operation button 16, the spool motor 31, the detection switch 44, the switching motor 51, the switching switch 58, and the color sensor 60 described above are electrically connected to the control unit 70. The control unit 70 is configured to determine whether the bobbin mounted on the spool shaft 32 is one of the small bobbin 17, the medium bobbin 18, or the large bobbin 19 based on the detected value from the color sensor 60. Further, the control unit 70 is configured to pulse-drive the switching motor 51 based on the bobbin determination result to rotate the switching lever 53 from the initial position to the first switching position or the second switching position. Further, the control unit 70 is configured to pulse-drive the spool motor 31 based on the signal from the operation button 16 and stop the spool motor 31 based on the detection signal from the detection switch 44.

(Operational Advantage)

Next, the operation and effect of the present embodiment will be described while explaining the operation of the bobbin winding device 20 when winding the bobbin on the small bobbin 17, the medium bobbin 18, and the large bobbin 19.

(The Operation of the Bobbin Winding Device 20 when Winding the Bobbin Thread Around the Small Bobbin 17)

As shown in FIG. 3, in the initial state of the bobbin winding device 20, the switching lever 53 is arranged at the initial position. That is, in the initial state of the bobbin winding device 20, the slide member 56 presses the switching switch 58, and the switching switch 58 outputs an ON signal to the control unit 70. Further, in the initial state of the bobbin winding device 20, the thread trimming slit 35C of the thread trimming holder 35 and the color sensor 60 are arranged so as to face each other in the upper-lower direction. Further, in the initial state of the bobbin winding device 20, the detection lever 41 is arranged at the pressing position, presses the detection switch 44, and the detection switch 44 outputs an ON signal to the control unit 70.

In this state, the small bobbin 17 is mounted on the upper end of the spool shaft 32. Specifically, the small bobbin 17 is pushed downward, the thread trimming holder 35 is lowered to a lowered position, and the small bobbin 17 is vertically sandwiched by the thread trimming holder 35 and the engaging hooks 33A of the bobbin stopper 33.

When the small bobbin 17 is mounted on the spool shaft 32, the control unit 70 determines the bobbin mounted on the spool shaft 32 based on the detection signal from the color sensor 60. Here, a small bobbin 17 is attached to the spool shaft 32. The small bobbin 17 is not formed with an identification unit corresponding to the identification unit 18C of the medium bobbin 18 or the identification unit 19C of the large bobbin 19. Therefore, the light emitted from the color sensor 60 to the small bobbin 17 is not roughly reflected by the small bobbin 17. As a result, the control unit 70 determines that the bobbin mounted on the spool shaft 32 is the small bobbin 17, and sets the bobbin winding device 20 to the small bobbin mode. Here, the switching lever 53 is arranged at the initial position. Therefore, the control unit 70 maintains the initial position state of the switching lever 53 without driving the switching motor 51.

In this state, the detection lever 41 is rotated to the other side in the rotation direction by the operation of the user to be arranged at the non-pressing position (see FIG. 7). As a result, the lever protrusion 41E of the detection lever 41 comes into contact with the first adjustment portion 57B1 of the slide unit 55, and the pressure on the detection switch 44 of the first lever arm 41A of the detection lever 41 is released. As a result, the detection switch 44 outputs an off signal to the control unit 70. Further, at the non-pressing position of the detection lever 41, the contact portion 43B of the lever contact 43 is arranged inside the small bobbin 17 and is arranged so as to be separated from each other on the radial outer side of the core portion 17A of the small bobbin 17.

When the user operates the operation button 16 in this state, the control unit 70 drives the spool motor 31. As a result, the bobbin thread is started to be wound around the small bobbin 17. When the bobbin thread is wound around the core portion 17A of the small bobbin 17, the winding diameter of the bobbin thread wound around the core portion 17A increases as the spool shaft 32 rotates, and the wound bobbin thread comes into contact with the contact portion 43B of the lever contact 43. As a result, as the winding diameter of the bobbin thread increases, the bobbin thread presses the lever contact 43, and the detection lever 41 rotates from the non-pressing position to one side in the rotation direction (arrow A direction side in FIG. 7) against the urging force of the switching spring 54.

When the winding diameter of the bobbin thread becomes substantially the same as the outer diameter of the small bobbin 17, the detection lever 41 reaches the intermediate position (see the detection lever 41 indicated by the two-dot chain line in FIG. 7). At the intermediate position of the detection lever 41, the direction of the urging force of the switching spring 54 is reversed, and the switching spring 54 urges the detection lever 41 to one side in the rotation direction. As a result, the urging force of the switching spring 54 causes the detection lever 41 to rotate from the intermediate position to the pressing position to press the detection switch 44. As a result, the detection switch 44 outputs an ON signal to the control unit 70.

When the control unit 70 detects the ON signal of the detection switch 44, the control unit 70 stops the drive of the spool motor 31 and completes the winding of the bobbin thread around the small bobbin 17. After the bobbin winding is completed around the small bobbin 17, the bobbin winding device 20 is in the same state as the initial state. Therefore, the control unit 70 ends the process for the bobbin winding device 20.

(The Operation of the Bobbin Winding Device 20 when Winding the Bobbin Thread Around the Medium Bobbin 18)

When the medium bobbin 18 is mounted on the upper end of the spool shaft 32 in the initial state of the bobbin winder 20, the thread trimming holder 35 descends to the lowered position, and the medium bobbin 18 is vertically sandwiched by the thread trimming holder 35 and the engaging hooks 33A of the bobbin stopper 33.

When the medium bobbin 18 is mounted on the spool shaft 32, the control unit 70 determines the bobbin mounted on the spool shaft 32 based on the detection signal from the color sensor 60. Here, the medium bobbin 18 is mounted on the spool shaft 32. Therefore, the red component of the light reflected from the identification unit 18C of the medium bobbin 18 to the color sensor 60 increases. As a result, the control unit 70 determines that the bobbin mounted on the spool shaft 32 is the medium bobbin 18. As a result, the control unit 70 sets the bobbin winding device 20 into the medium bobbin mode.

That is, as shown in FIG. 8, the control unit 70 pulse drives the switching motor 51 to rotate the switching lever 53 from the initial position to one side in the rotation direction and arrange the switching lever 53 at the first switching position. When the switching lever 53 rotates, the slide unit 55 slides from the non-operating position to the first slide position in conjunction with the rotation of the switching lever 53. As a result, the pressing state of the slide unit 55 against the switching switch 58 is released, and the switching switch 58 outputs an off signal to the control unit 70.

In this state, the detection lever 41 is rotated to the other side in the rotation direction by the operation of the user to be arranged at the non-pressing position. As a result, the lever protrusion 41E of the detection lever 41 comes into contact with the second adjusting portion 57B2 of the slide unit 55. That is, as compared with the small bobbin mode, the non-pressing position of the detection lever 41 is changed to one side in the rotation direction. Further, in this state, the pressure on the detection switch 44 of the first lever arm 41A of the detection lever 41 is released, and the detection switch 44 outputs an off signal to the control unit 70. Further, at the non-pressing position of the detection lever 41, the contact portion 43B of the lever contact 43 is arranged inside the medium bobbin 18 and is arranged so as to be separated from each other on the radial outer side of the core portion 18A of the small bobbin 18.

When the user operates the operation button 16 in this state, the control unit 70 drives the spool motor 31. As a result, the bobbin thread is started to be wound around the medium bobbin 18. When the bobbin thread is wound around the core portion 18A of the medium bobbin 18, the winding diameter of the bobbin thread wound around the core portion 18A increases as the spool shaft 32 rotates, and the wound bobbin thread comes into contact with the contact portion 43B of the lever contact 43. As a result, as the winding diameter of the bobbin thread increases, the bobbin thread presses the lever contact 43, and the detection lever 41 rotates from the non-pressing position to one side in the rotation direction against the urging force of the switching spring 54.

In the medium bobbin mode, since the switching lever 53 is arranged at the first switching position, the intermediate position of the detection lever 41 is changed to one side in the rotation direction as compared with the small bobbin mode. That is, the position of the lever contact 43 corresponding to the intermediate position of the detection lever 41 is changed to the radial outer side of the core portion 18A as compared with the small bobbin mode. When the winding diameter of the bobbin thread becomes substantially the same as the outer diameter of the medium bobbin 18, the detection lever 41 reaches the intermediate position. Then, at the intermediate position of the detection lever 41, the direction of the urging force of the switching spring 54 is reversed, and the switching spring 54 urges the detection lever 41 to one side in the rotation direction. As a result, the urging force of the switching spring 54 causes the detection lever 41 to rotate from the intermediate position to the pressing position to press the detection switch 44. As a result, the detection switch 44 outputs an ON signal to the control unit 70.

When the control unit 70 detects the ON signal of the detection switch 44, the control unit 70 stops the drive of the bobbin motor 31 and completes the winding of the bobbin thread around the medium bobbin 18. Further, the control unit 70 pulse drives the switching motor 51 to rotate the switching lever 53 from the first switching position to the other side in the rotation direction (the side in the arrow D direction in FIG. 8) to arrange the switching lever 53 at the initial position. When the switching lever 53 rotates, the slide unit 55 slides to the left in conjunction with the rotation of the switching lever 53 and returns to the non-operating position. In this state, the switch pressing unit 56C of the slide unit 55 presses the switching switch 58, and the switching switch 58 outputs an ON signal to the control unit 70. Therefore, the bobbin winding device 20 returns to the initial state. As a result, the control unit 70 ends the process for the bobbin winding device 20.

(Operation of Bobbin Thread Winding Device 20 when Winding Bobbin Thread Around a Large Bobbin 19)

When the large bobbin 19 is mounted on the upper end of the spool shaft 32 in the initial state of the bobbin winding device 20, at the raised position of the thread trimming holder 35, the large bobbin 19 is vertically sandwiched by the thread trimming holder 35 and the engaging hooks 33A of the bobbin stopper 33.

When the large bobbin 19 is mounted on the spool shaft 32, the control unit 70 determines the bobbin mounted on the spool shaft 32 based on the detection signal from the color sensor 60. Here, a large bobbin 19 is mounted on the spool shaft 32. Therefore, the blue component of the light reflected from the large bobbin 19 to the color sensor 60 increases. As a result, the control unit 70 determines that the bobbin mounted on the spool shaft 32 is a large bobbin 19. As a result, the control unit 70 puts the bobbin winding device 20 into the large bobbin mode.

That is, as shown in FIG. 9, the control unit 70 pulse drives the switching motor 51 to rotate the switching lever 53 from the initial position to one side in the rotation direction and arrange the switching lever 53 at the second switching position. When the switching lever 53 rotates, the slide unit 55 slides from the non-operating position to the second slide position in conjunction with the rotation of the switching lever 53. As a result, the pressing state of the slide unit 55 against the switching switch 58 is released, and the switching switch 58 outputs an off signal to the control unit 70.

In this state, the detection lever 41 is rotated to the other side in the rotation direction by the operation of the user to be arranged at the non-pressing position. As a result, the lever protrusion 41E of the detection lever 41 comes into contact with the third adjusting portion 57B3 of the slide unit 55. That is, the non-pressing position of the detection lever 41 is changed to one side in the rotation direction as compared with the small bobbin mode and the medium bobbin mode. Further, in this state, the pressure on the detection switch 44 of the first lever arm 41A of the detection lever 41 is released, and the detection switch 44 outputs an off signal to the control unit 70. Further, at the non-pressing position of the detection lever 41, the contact portion 43B of the lever contact 43 is arranged inside the large bobbin 19 and is arranged so as to be separated from each other on the radial outer side of the core portion 19A of the large bobbin 19.

When the user operates the operation button 16 in this state, the control unit 70 drives the spool motor 31. As a result, the bobbin thread is started to be wound around the large bobbin 19. When the bobbin thread is wound around the core portion 19A of the large bobbin 19, the winding diameter of the bobbin thread wound around the core portion 19A increases as the spool shaft 32 rotates, and the wound bobbin thread comes into contact with the contact portion 43B of the lever contact 43. As a result, as the winding diameter of the bobbin thread increases, the bobbin thread presses the lever contact 43, and the detection lever 41 rotates from the non-pressing position to one side in the rotation direction against the urging force of the switching spring 54.

In the large bobbin mode, since the switching lever 53 is arranged at the second switching position, the intermediate position of the detection lever 41 is changed to one side in the rotation direction as compared with the small bobbin mode and the medium bobbin mode. That is, the position of the lever contact 43 corresponding to the intermediate position of the detection lever 41 is changed to the radial outer side of the core portion 19A as compared with the small bobbin mode and the medium bobbin mode. When the winding diameter of the bobbin thread becomes substantially the same as the outer diameter of the large bobbin 19, the detection lever 41 reaches the intermediate position. Then, at the intermediate position of the detection lever 41, the direction of the urging force of the switching spring 54 is reversed, and the switching spring 54 urges the detection lever 41 to one side in the rotation direction. As a result, the urging force of the switching spring 54 causes the detection lever 41 to rotate from the intermediate position to the pressing position to press the detection switch 44. As a result, the detection switch 44 outputs an ON signal to the control unit 70.

When the control unit 70 detects the ON signal of the detection switch 44, the control unit 70 stops the drive of the bobbin motor 31 and completes the winding of the bobbin thread around the large bobbin 19. Further, the control unit 70 pulse drives the switching motor 51 to rotate the switching lever 53 from the second switching position to the other side in the rotation direction (the side in the arrow D direction in FIG. 9) to arrange the switching lever 53 at the initial position. When the switching lever 53 rotates, the slide unit 55 slides to the left in conjunction with the rotation of the switching lever 53 and returns to the non-operating position. In this state, the switch pressing unit 56C of the slide unit 55 presses the switching switch 58, and the switching switch 58 outputs an ON signal to the control unit 70. Therefore, the bobbin winding device 20 returns to the initial state. As a result, the control unit 70 ends the process for the bobbin winding device 20.

As described above, the bobbin winding device 20 of the present embodiment has a switching motor 51 and a switching lever 53 connected to the switching motor 51. The switching motor 51 is driven by the control unit 70, and the switching lever 53 is rotated from the initial position to the first switching position or the second switching position, so that the intermediate position of the detection lever 41 is changed to one side in the rotation direction of the detection lever 41. Thereby, the winding diameter of the bobbin thread wound around the bobbins having different diameters (small bobbin 17, medium bobbin 18, and large bobbin 19) can be changed.

Here, the bobbin winding device 20 has a color sensor 60, and the color sensor 60 detects the outer diameter of the bobbin mounted on the spool shaft 32. Specifically, the control unit 70 determines the color attached to the bobbin based on the detection signal from the color sensor 60, and detects the outer diameter of the bobbin mounted on the spool shaft 32. The control unit 70 drives the switching motor 51 to rotate the switching lever 53 from the initial position to the first switching position or the second switching position based on the detected outer diameter of the bobbin. Therefore, the user can wind the bobbin thread around the bobbins having different outer diameters without rotating the switching lever 53 from the initial position based on the outer diameter of the bobbins to be mounted. As a result, the convenience for the user can be improved.

Further, a slide member 56 that slides in conjunction with the rotation of the switching lever 53 is connected to the switching lever 53, and an adjusting plate 57 is fixed to the slide member 56. The non-pressing position of the detection lever 41 is changed to one side in the rotation direction when the switching lever 53 rotates from the initial position to the first switching position or the second switching position and the lever protrusion 41E of the detection lever 41 in the non-pressing position comes into contact with the first adjustment portion 57B1 or second adjustment portion 57B2 of the adjustment plate 57. That is, in the medium bobbin mode or the large bobbin mode of the bobbin winding device 20, the non-pressing position of the detection lever 41 is changed to one side in the rotation direction of the detection lever 41 as compared with the small bobbin mode of the bobbin winding device 20. As a result, the bobbin thread can be satisfactorily wound around the medium bobbin 18 or the large bobbin 19.

That is, when the bobbin thread is wound around the medium bobbin 18 or the large bobbin 19, the bobbin thread wound around the core portion 18A or the core portion 19A presses the lever contact 43 to rotate the detection lever 41 to one side in the rotation direction against the urging force of the switching spring 54. At this time, a contact resistance is generated between the bobbin thread and the lever contact 43. Further, the winding diameter of the bobbin thread wound around the medium bobbin 18 or the large bobbin 19 is set to be larger than the winding diameter of the bobbin thread wound around the small bobbin 17. In other words, the position of the lever contact 43 corresponding to the intermediate position of the detection lever 41 in the medium bobbin mode and the large bobbin mode is set radially outside the spool shaft 32 as compared with the position of the lever contact 43 corresponding to the intermediate position of the detection lever 41 in the small bobbin mode.

Here, if the slide unit 55 is omitted in the bobbin winding device 20, the non-pressing position of the detection lever 41 in the medium bobbin mode or the large bobbin mode is the same as the non-pressing position of the detection lever 41 in the small bobbin mode. That is, the position of the lever contact 43 in the medium bobbin mode (large bobbin mode) is close to the medium bobbin 18 (large bobbin 19). Therefore, the contact period between the bobbin thread and the lever contact 43 (the period from the start of contact of the bobbin thread with the lever contact 43 until the lever contact 43 reaches the position corresponding to the intermediate position of the detection lever 41 and the contact state between the bobbin thread and the lever contact 43 is released) is longer than that in the present embodiment. The torque of the bobbin motor 31 is set to be relatively low. Therefore, if the slide unit 55 is omitted in the bobbin winding device 20, the contact resistance between the bobbin thread and the lever contact 43 may hinder the rotation of the bobbin motor 31 and prevent the bobbin thread from being wound well around the medium bobbin 18 and the large bobbin 19.

On the other hand, in the bobbin winding device 20 of the present embodiment, in the medium bobbin mode or the large bobbin mode, when the lever protrusion 41E of the detection lever 41 in the non-pressing position comes into contact with the adjusting portion 57B of the adjusting plate 57, the non-pressing position of the detection lever 41 is changed to one side in the rotation direction as compared with the small bobbin mode. As a result, the contact period between the bobbin thread and the lever contact 43 can be shortened as compared with the case where the slide unit 55 is omitted. Therefore, the rotation failure of the bobbin motor 31 due to the contact resistance between the bobbin thread and the lever contact 43 can be suppressed, and the bobbin thread can be satisfactorily wound around the medium bobbin 18 and the large bobbin 19.

The left end of the adjusting plate 57 is rotatably supported by the connecting pin 56B. Further, a fixing hole 57A through which the screw SC4 is inserted is formed through the right end portion of the adjusting plate 57, and the fixing hole 57A is formed in an oblong hole shape with the rotation direction of the adjusting plate 57 as the longitudinal direction. Thereby, the position of the adjustment plate 57 can be appropriately changed to finely adjust the non-pressing position of the detection lever 41 in the medium bobbin mode or the large bobbin mode.

Figure 11A:
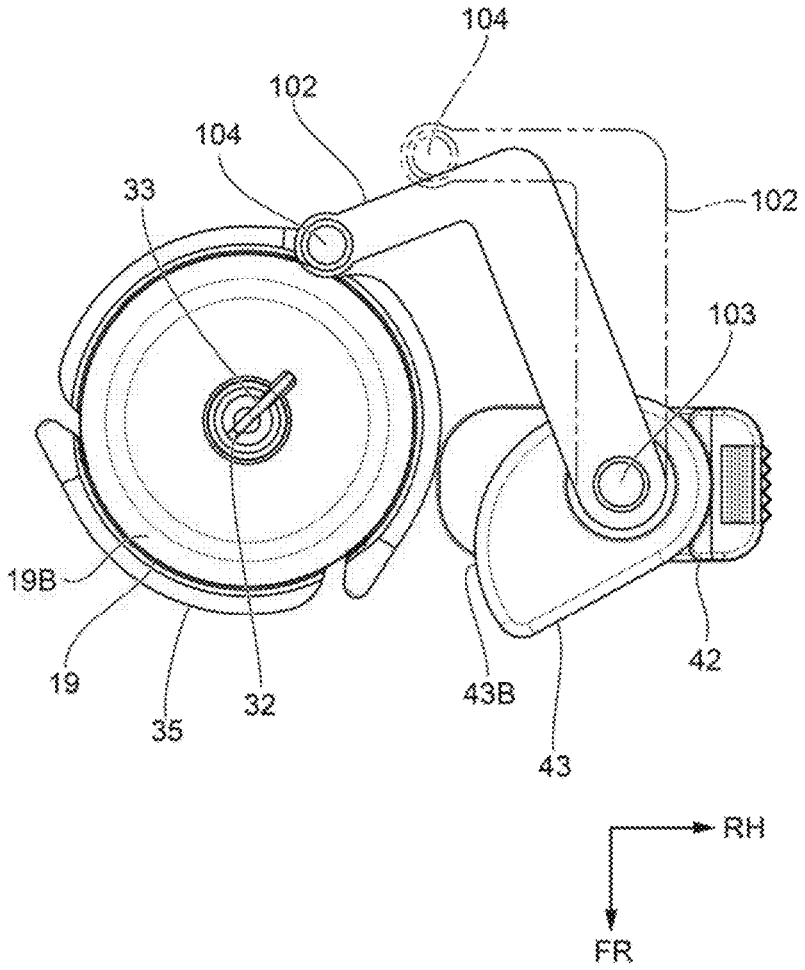
FIG. 11A is a plan view showing the detection lever of the outer diameter detecting mechanism for detecting the outer diameter of the bobbin.
Figure 11B:
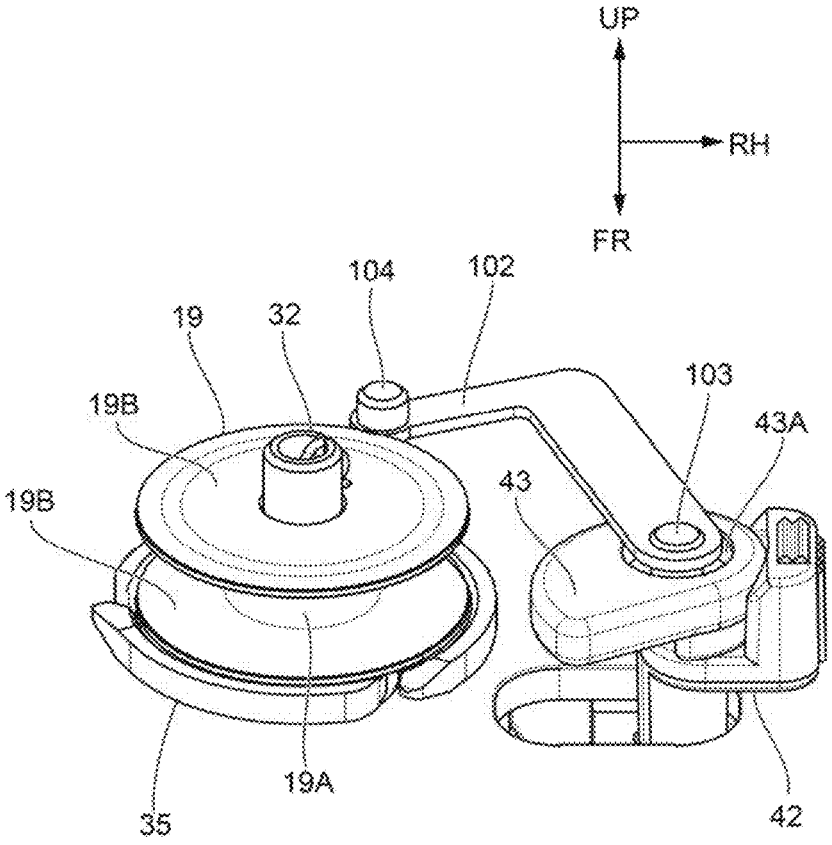
FIG. 11B is a perspective view of the detection lever of FIG. 11A.
Figure 12:
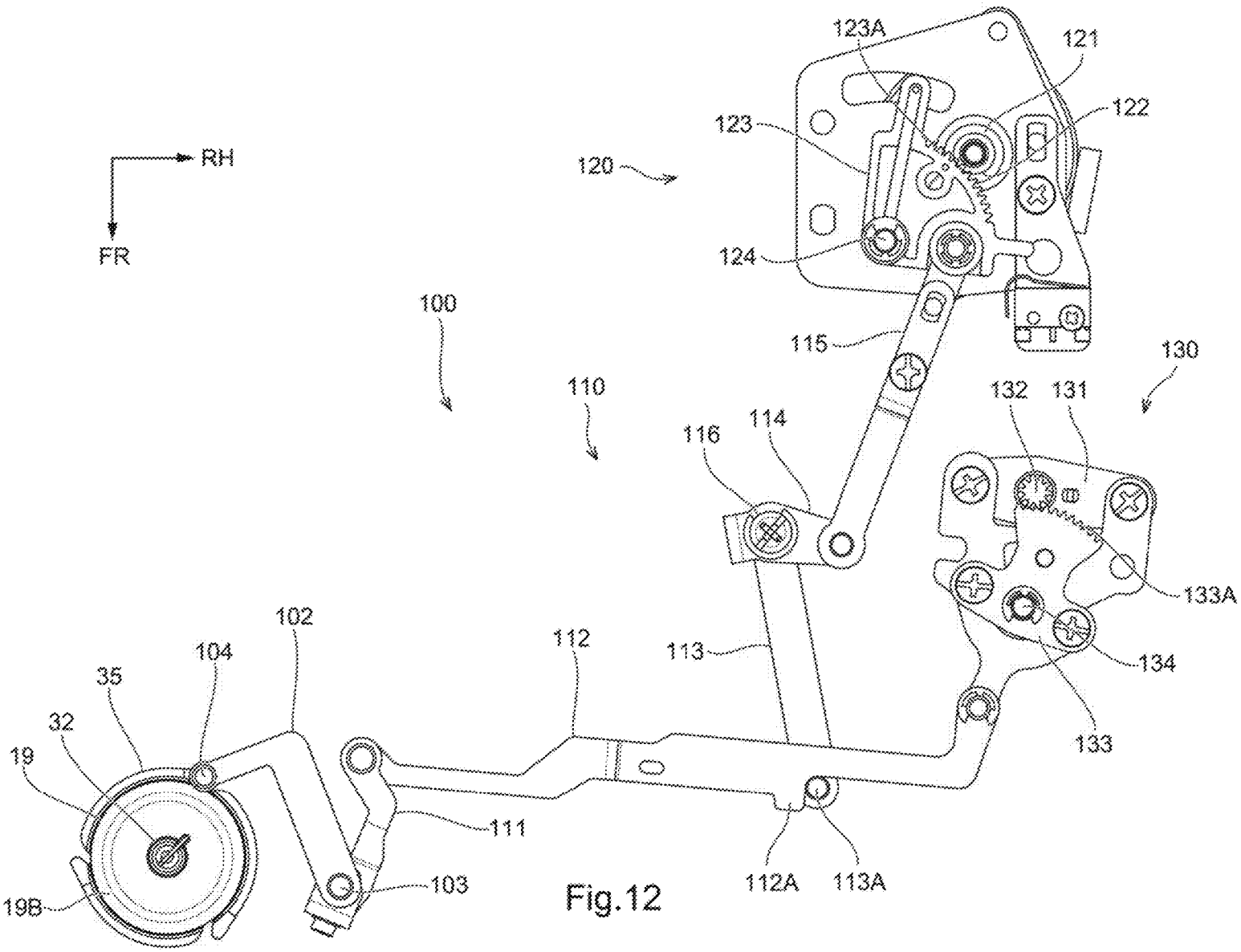
FIG. 12 is a plan view showing the outer diameter detecting mechanism for detecting the outer diameter of the bobbin.

In the present embodiment, the color sensor 60 is configured to determine the bobbin mounted on the spool shaft 32 and detect the outer diameter of the bobbin. However, the method of detecting the outer diameter of the bobbin mounted on the spool shaft 32 is not limited to this. For example, as shown in FIGS. 11 and 12, the bobbin winding device 20 may be provided with an outer diameter detecting mechanism unit 100 as a mechanical "outer diameter detector" so as to detect the outer diameter of the bobbin mounted on the spool shaft 32. Hereinafter, the outer diameter detecting mechanism unit 100 will be described.

As shown in FIGS. 11 and 12, the outer diameter detecting mechanism unit 100 includes a detection lever 102, a link mechanism unit 110, a lever drive unit 120, and a rotation position detection unit 130.

The detection lever 102 is formed in a roughly L-shaped plate shape in a plan view, and is arranged on the outer side in the radial direction of the spool shaft 32. The base end portion of the detection lever 102 is integrally rotatably connected to the lever support shaft 103 whose axial direction is the upper-lower direction, and the detection lever 102 is configured to rotate about the axis of the lever support shaft 103. The lever support shaft 103 is arranged, for example, in the fixing hole 43A of the lever contact 43. A detection pin 104 is provided at the tip of the detection lever 102, and the detection pin 104 is formed in a roughly columnar shape with the upper-lower direction as the axial direction, and projects upward from the detection lever 102. Then, the detection lever 102 is configured to rotate around the lever support shaft 103 so that the detection pin 104 comes into contact with the flange portion of the bobbin mounted on the spool shaft 32 (the flange portion 19B of the large bobbin 19 in FIG. 11) (Hereinafter, the position of the detection lever 102 in which the detection pin 104 abuts on the flange portion of the bobbin is referred to as a contact position). As a result, the outer diameter of the bobbin mounted on the spool shaft 32 can be detected by detecting the amount of rotation of the detection lever 102 from the lever initial position (the position indicated by the two-dot chain line in FIG. 11) to the contact position by the potentiometer 131 described later.

The link mechanism unit 110 includes a first link 111, a second link 112, a third link 113, a fourth link 114, and a fifth link 115. One end of the first link 111 is integrally rotatably connected to the lever support shaft 103. That is, the detection lever 102 and the first link 111 are configured to be integrally rotatable around the axis of the lever support shaft 103.

The second link 112 extends in the left-right direction, and one end of the second link 112 is connected to the other end of the first link 111 so as to be relatively rotatable with the upper-lower direction as the axial direction. A link projecting portion 112A projecting to the front side is formed at the intermediate portion in the longitudinal direction of the second link 112. Further, the second link 112 is urged to the right by a spring (not shown).

The third link 113 extends in the upper-lower direction, and a link pin 113A is provided at the front end portion of the third link 113. The link pin 113A is arranged adjacent to the right side of the link protrusion 112A of the second link 112 and engages with the link protrusion 112A. It is configured that the rear end of the third link 113 is integrally rotatably connected to the link support shaft 116 whose axial direction is the upper-lower direction, and the third link 113 rotate about the axis of the link support shaft 116.

It is configured that one end of the fourth link 114 is integrally rotatably connected to the link support shaft 116, and the fourth link 114 rotate about the axis of the link support shaft 116. As a result, the third link 113 and the fourth link 114 are configured to be integrally rotatable around the axis of the link support shaft 116.

The fifth link 115 extends in the front-rear direction, and the front end portion of the fifth link 115 is connected to the other end portion of the fourth link 114 so as to be relatively rotatable with the upper-lower direction as the axial direction.

The lever drive unit 120 includes a drive motor 121 and a drive gear 123. The drive motor 121 is arranged with the upper-lower direction as the axial direction, and a pinion gear 122 is provided on the output shaft of the drive motor 121 so as to be integrally rotatable. The drive motor 121 is electrically connected to the control unit 70, and the drive motor 121 is driven by the control unit 70.

The drive gear 123 is formed in a roughly fan-shaped plate shape with the upper-lower direction as the axial direction, and the base end portion of the drive gear 123 is rotatably supported by the gear support shaft 124 with the upper-lower direction as the axial direction. A gear portion 123A formed at the tip end portion of the drive gear 123 is meshed with the pinion gear 122. Further, the rear end portion of the fifth link 115 is connected so as to be relatively rotatable with the upper-lower direction as the axial direction at a position eccentric with respect to the rotation shaft (gear support shaft 124) of the drive gear 123. As a result, when the drive motor 121 is driven, the driving force of the drive motor 121 is transmitted to the detection lever 102 by the link mechanism unit 110, and the detection lever 102 is configured to rotate around the axis of the lever support shaft 103.

The rotation position detection unit 130 includes a potentiometer 131 and a transmission lever 133. The potentiometer 131 is configured as a rotary type meter and is electrically connected to the control unit 70. A meter gear 132 is provided on the rotating shaft of the potentiometer 131 so as to be integrally rotatable. The transmission lever 133 is formed in a plate shape having a plate thickness direction in the upper-lower direction, and an intermediate portion in the front-rear direction of the transmission lever 133 is rotatably supported by a lever support shaft 134 having an axial direction in the upper-lower direction. The other end of the second link 112 described above is connected to the front end of the transmission lever 133 so as to be relatively rotatable. A gear portion 133A is formed on the outer peripheral portion of the rear end portion of the transmission lever 133, and the gear portion 133A is meshed with the meter gear 132. When the link mechanism unit 110 is operated, the rotation shaft of the potentiometer 131 is rotated to output a detection signal from the potentiometer 131 to the control unit 70.

As a result, according to the outer diameter detecting mechanism unit 100, the control unit 70 detects the rotation position of the detection lever 102 according to the rotation amount of the detection lever 102, and the control unit 70 can determine the outer diameter of the bobbin mounted on the spool shaft 32. When the outer diameter detection mechanism unit 100 is used instead of the color sensor 60, the identification unit 18C can be omitted in the medium bobbin 18 and the identification unit 19C can be omitted in the large bobbin 19.

DESCRIPTION OF THE REFERENCE NUMERALS

10 sewing machine
12 sewing machine body
12A pedestal portion
12B arm portion
12C bed portion
13 cover
14 thread stand rod
15 thread winding guide
16 operation button
17 small bobbin (bobbin)
17A core portion
17B flange portion
18 medium bobbin (bobbin)
18A core portion
18B flange portion
18C identification unit
19 large bobbin (bobbin)
19A core portion
19B flange portion
19C identification unit
20 bobbin winding device
22 base plate
23 first shaft
24 second shaft
26 support pin
30 thread winding mechanism unit
31 spool motor
31A output shaft
32 spool shaft
32A slit
33 bobbin stopper (engaging member)
33A engaging hook (engaging portion)
34 triangular cam
34A mounting cylinder
35 thread trimming holder
35A mounting portion
35B hook portion
35C thread trimming slit
36 holder stopper
36A insertion hole
37 holder urging spring
40 thread winding detection mechanism unit
41 detection lever (rotating body)
41A first lever arm
41B second lever arm
41D fitting hole
41E lever protrusion
41F locking hole
42 lever operation unit
43 lever contact (contact portion)
43A fixing hole
43B contact portion
44 detection switch (switch)
50 switching mechanism unit
51 switching motor (motor)
51A output shaft
52 pinion gear
53 switching lever (switching member)
53A lever body
53B lever connection portion
53C switching gear portion
53D locking portion
53E first locking hole
53F connecting hole
54 switching spring (urging member)
55 slide unit (position change member)
56 slide member
56A slide hole
56B connecting pin
56C switch pressing portion
57 adjustment plate
57A fixing hole
57B adjustment unit
57B1 first adjustment portion
57B2 second adjustment portion
57B3 third adjustment portion
58 switching switch
59 switch holder
60 color sensor (outer diameter detector)

70 control unit
100 outer diameter detecting mechanism unit (outer diameter detector)
102 detection lever
103 lever support shaft
104 detection pin
110 link mechanism unit
111 first link
112 second link
112A link protrusion
113 third link
113A link pin
114 fourth link
115 fifth link
116 link support shaft
120 lever drive unit
121 drive motor
122 pinion gear
123 drive gear
123A gear portion
124 gear support shaft
130 rotation position detection unit
131 potency meter
132 meter gear
133 transmission lever
133A gear portion
134 lever support shaft
SC1 screw
SC2 screw
SC3 screw
SC4 screw

What is claimed is:

1. A bobbin winding device comprising:

a spool shaft on which a bobbin is mounted;

a switch that detects completion of winding bobbin thread around the bobbin;

a rotating body that is rotatable around an axis parallel to the spool shaft and that presses the switch, such that the rotating body moves from a non-pressing position separated from the switch to a pressing position by passing through an intermediate position along one rotation direction;

a contact portion that is provided on the rotating body, wherein the contact portion is configured so that it can come into contact with the bobbin thread, and is arranged radially outside a core portion of the bobbin at the non-pressing position and is pressed by the bobbin thread wound around the bobbin to rotate the rotating body to the pressing position along the one rotation direction;

a spring that urges the rotating body against the one rotation direction at the non-pressing position when the rotating body extends passed the intermediate position, and urges the rotating body along the one rotation direction at the pressing position when the rotating body extends passed the intermediate position;

a switching member that is rotatable around a switching member axis parallel to the spool shaft, is connected to the spring, and the switching member rotates to change a position of the rotating body at the intermediate position;

a motor that is connected to the switching member and rotates the switching member;

an outer diameter detector that detects the outer diameter of the bobbin; and a control unit comprising a processor, the control unit driving the motor based on the outer diameter of the bobbin detected by the outer diameter detector and rotates the switching member.

2. The bobbin winding device according to claim 1, wherein the outer diameter detector is a color sensor that detects the color of a part of the bobbin.

3. The bobbin winding device according to claim 1, comprising a position changing member configured to be movable in conjunction with the rotation of the switching member and to be in contact with the rotating body at the non-pressing position, wherein, the switching member rotates along the one rotation direction, and the rotating body comes into contact with the position changing member, so that the non-pressing position is changed along the one rotation direction of the rotating body.

4. A sewing machine comprising the bobbin winding device according to claim 1.

5. The bobbin winding device according to claim 2, comprising a position changing member configured to be movable in conjunction with the rotation of the switching member and to be in contact with the rotating body at the non-pressing position, wherein, the switching member rotates along the one rotation direction, and the rotating body comes into contact with the position changing member, so that the non-pressing position is changed along the one rotation direction of the rotating body.

6. A sewing machine comprising the bobbin winding device according to claim 2.

7. A sewing machine comprising the bobbin winding device according to claim 3.

* * * * *